US005158043A

United States Patent [19]

Emsbo

[11] Patent Number: 5,158,043

[45] Date of Patent: Oct. 27, 1992

[54] HIGH TEMPERATURE APPLICATION DOOR INSTALLATION

[76] Inventor: Jon Emsbo, 21 Bryers La., Upper Saddle River, N.J. 07458

[21] Appl. No.: 622,060

[22] Filed: Dec. 4, 1990

[51] Int. Cl.[5] ..... F23M 7/04

[52] U.S. Cl. ..... 122/498; 110/173 R; 110/180; 122/6.5

[58] Field of Search ..... 122/6.5, 498; 110/173 R, 180

[56] References Cited

U.S. PATENT DOCUMENTS

| | | |
|---|---|---|
| 87,438 | 3/1869 | Shear . |
| 140,730 | 7/1873 | Rees . |
| 471,667 | 3/1892 | Fea . |
| 578,363 | 3/1897 | Ross et al. . |
| 725,746 | 4/1903 | Moore . |
| 2,584,404 | 2/1952 | Webb . |
| 2,662,053 | 12/1953 | Brown . |
| 2,744,858 | 5/1956 | Homan . |
| 2,758,554 | 8/1956 | Homan . |
| 2,920,585 | 1/1960 | Grossman et al. . |
| 2,993,845 | 7/1961 | Coe . |
| 3,001,488 | 9/1961 | Godshalk et al. . |
| 3,015,614 | 1/1962 | Bowman . |
| 3,043,250 | 7/1962 | Nyberg . |
| 3,055,321 | 9/1962 | Patrick . |
| 3,112,736 | 12/1963 | Reighart . |
| 3,156,218 | 11/1964 | Braun . |
| 3,214,154 | 10/1965 | Olsson . |
| 3,797,172 | 3/1974 | Cannon . |
| 3,854,262 | 12/1974 | Brady . |
| 4,036,702 | 7/1977 | Nagayoshi . |
| 4,097,228 | 6/1978 | Rosling . |
| 4,207,706 | 6/1980 | Haines . |
| 4,406,619 | 9/1983 | Oldengott . |
| 4,570,550 | 2/1986 | Wilt ..... 110/180 |
| 4,574,973 | 3/1986 | Lewis et al. . |
| 4,685,586 | 8/1987 | Lewis et al. . |
| 4,917,772 | 4/1990 | Koschlig et al. . |

FOREIGN PATENT DOCUMENTS

| | | | |
|---|---|---|---|
| 1408786 | 7/1965 | France | 122/498 |

*Primary Examiner*—Edward G. Favors
*Attorney, Agent, or Firm*—Dennis H. Lambert

[57] ABSTRACT

This invention comprises a door for gas-tight sealing engagement in an access opening in environments involving high temperature. In one embodiment, the door is a boiler access door provided through a waterwall in a boiler, and includes a tapered insulation plug for sealing engagement in a tapered opening in the waterwall. In a preferred embodiment, the tapered sides are stepped and the insulation comprises multiple layers, which may be of different grades of insulation material. The stepped insulation defines a plurality of linearly aligned contact surfaces for engagement with a plurality of cooling tubes defining the sides of the access opening. This contact with the cooling tubes not only impede flow of hot gas between the door and frame, protecting the seal and the outer portions of the door from the heat, but also result in cooling of the insulation plug. In another embodiment, the door includes a spring loaded sealing plate which is yieldably biased to define a preload and prevent opening and closing movement of the door when the door opening and closing mechanism and/or the door are not in the proper operative position. In a further embodiment, a protective metal sheath is provided on the insulation plug, and includes expansion joints between adjoining plates, with telescoping tabs to maintain the plates in substantial alignment.

23 Claims, 25 Drawing Sheets

FIG. 12
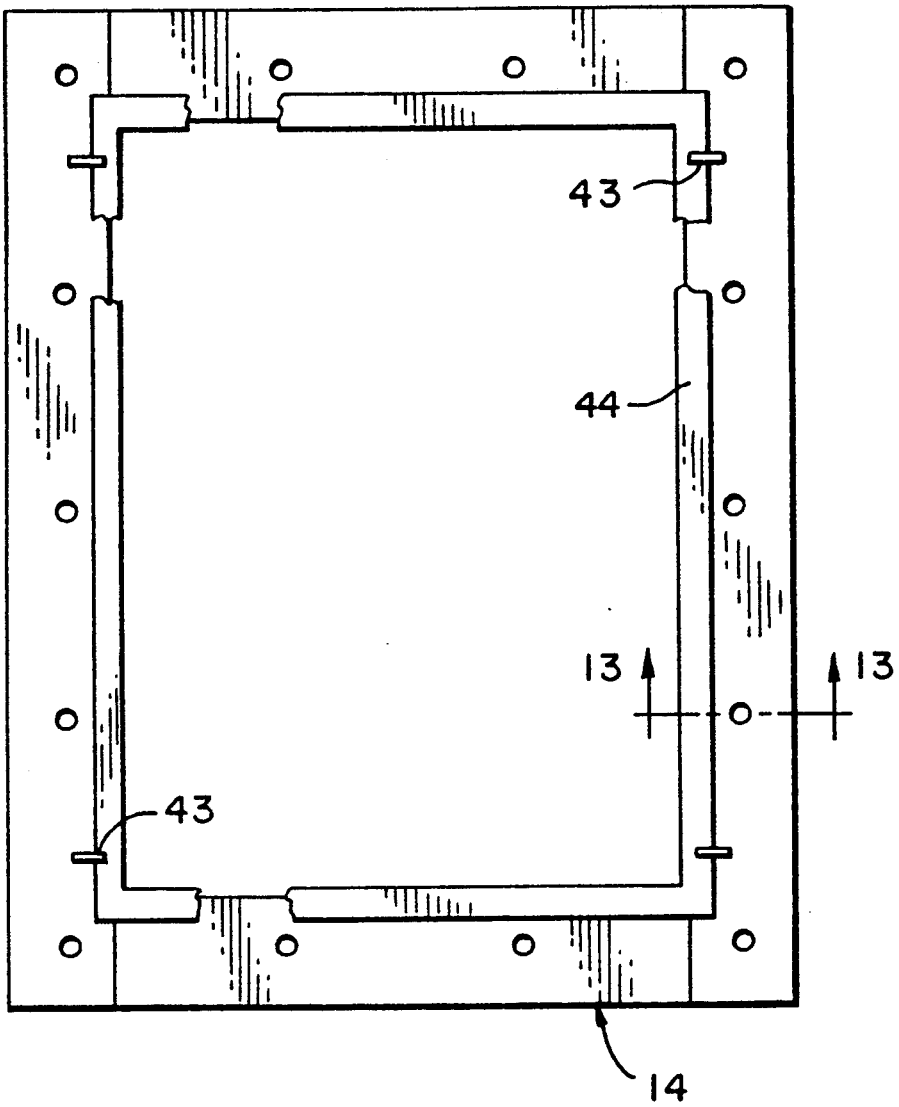
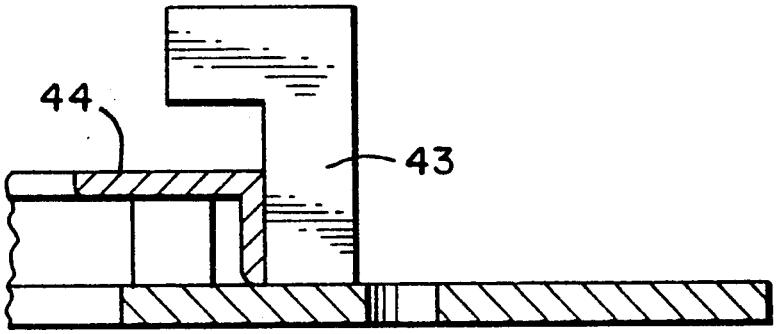
FIG. 13

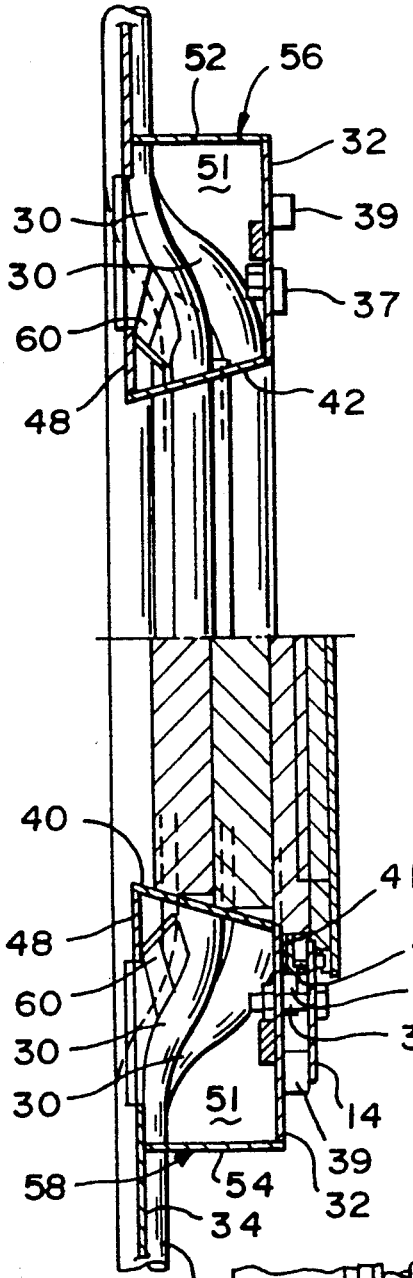
FIG. 20
FIG. 19
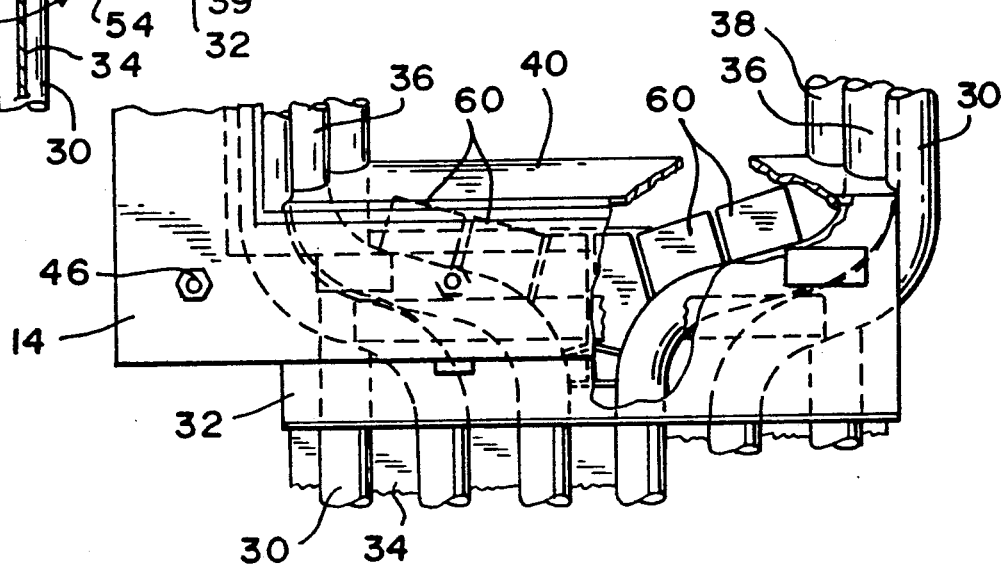

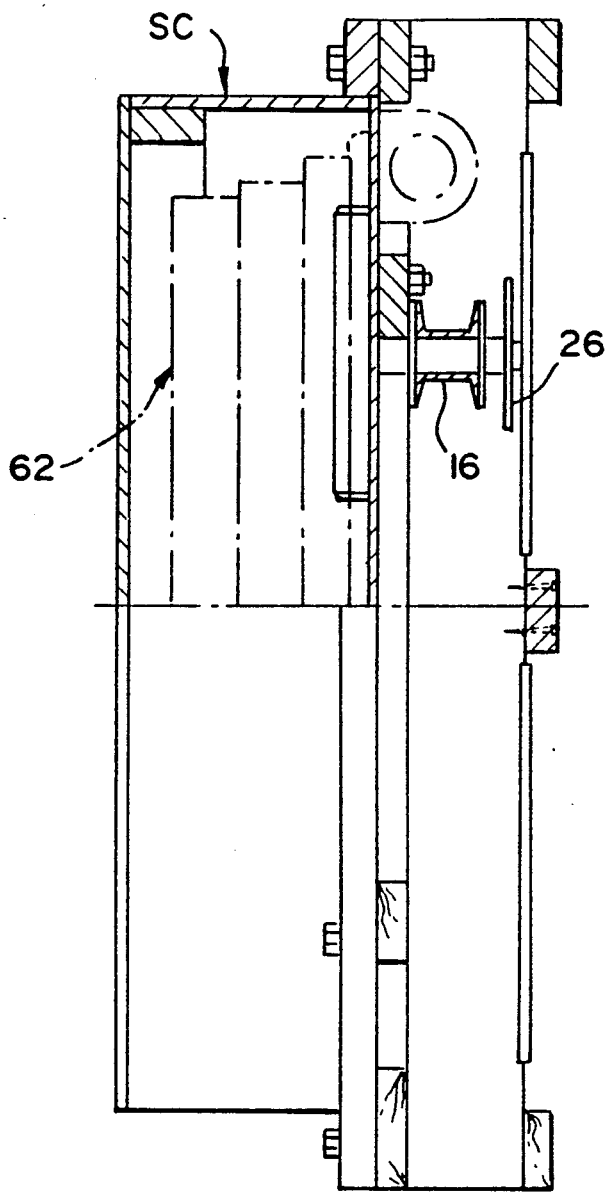
FIG. 51
FIG. 52
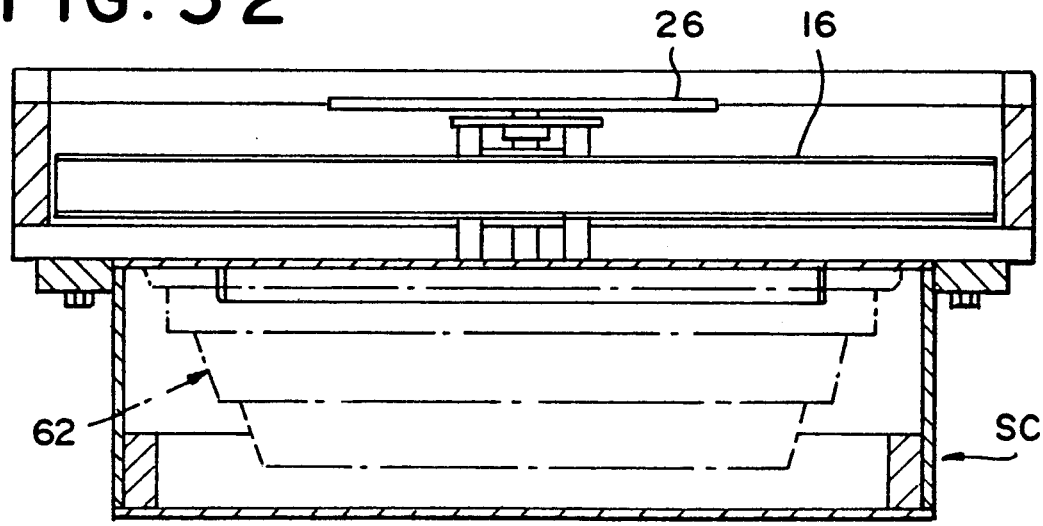

HIGH TEMPERATURE APPLICATION DOOR INSTALLATION

FIELD OF THE INVENTION

This invention relates to access doors for high temperature, gas-tight applications such as boiler doors, boiler penthouse access doors, flues, baghouses, precipitators, scrubbers and the like.

PRIOR ART

In the flame areas of large industry and power boilers, the walls are typically made from vertically oriented steel boiler tubes containing rising streams of water under very high pressure, and temperatures of up to 1000° F. The gas temperature in the hottest areas inside some boilers may reach 2700° F., and in the burning zone radiation from the fireball could cause uncooled, interior surfaces to reach 3000° F.

The steel boiler tubes in a boiler "waterwall" are typically 2 to 3 inches in outside diameter. In some boilers, the tubes in the waterwall will have a distance between the outside of adjacent tubes of approximately ½ to 3 inches, and this space will be filled with a steel bar, referred to hereinafter as a "membrane", and which is about ¼ to ⅜ inch thick and is welded gas-tight to the adjoining tubes, thereby forming a continuous and gas-tight wall of tubes and membrane. Such walls are typically insulated on the outside with mineral wool or ceramic fiber insulation, which is typically covered by corrugated steel or aluminum cladding.

In other types of boilers, the tubes in the waterwall are not joined by a membrane. In such cases, the tubes are usually closer together, or the sides of the tubes have welded-on fins which fill all or part of the gap between tubes without forming a gas-tight wall. In such boilers, the exterior mineral wool insulation is generally surrounded by a gas-tight boiler casing.

To gain access to the inside of the boilers or other structures for inspection, repair and maintenance, there are usually one or more access openings with doors in the waterwalls. Where such doors are installed there must be made a penetration in the waterwall. Since none of the water tubes in the waterwall can be blocked off, it is necessary to bend two, three, or more tubes to either side to provide the opening. Usually, the tubes are bent outwardly toward the outside of the boiler.

Most of the existing doors of conventional design are expensive, heavy, bulky and with frames often cast in heat resistant steels, which must be surrounded by and anchored in castable refractory. Some doors are cooled with water running through internal compartments or cooling coils. The opening and tight closing of these doors are typically major events requiring a small crew of people with tools and torches.

Initial or retrofit installation of prior art doors is complex and labor intensive, and due to the bulkiness of the design, it is usually necessary to bend back more tubes to make space for an inserted door frame which is larger than the required access opening. Installation of the door frame is also complex and requires great care and skill to accomplish accurately.

Further, in prior art designs, the screw jack that serves to release the door for opening and closing movement may be easily operated when the door is in an open position, thereby positioning the seal carried by the door plate so that it could be damaged against the door frame when the door is subsequently closed. For example, in the doors described in U.S. Pat. Nos. 4,574,973 and 4,685,586, if the door plate is not pulled back sufficiently by turning the closing screws counterclockwise when the door is being opened or closed, it could result in the sealing gasket at the hinge side of the door being damaged or torn off by shear force when it rubs against the frame plate The risk of such damage can be reduced if the door will not open until the door plate is screwed all the way out.

Also, prior art doors usually have only a single layer or grade of insulation, which must be of high quality in order to withstand the temperatures involved, and therefore adds to the cost of the door. Moreover, prior art doors are sealed to their frame in such a way that the seal may become exposed to the abrasive action of hot gas and ash inside the area sealed by the door.

SUMMARY OF THE INVENTION

Contrary to prior art designs, the door of the invention has no forced direct air or liquid cooling and has no interior frame of metal or refractory that must be installed inside the opening through the waterwall. This means that fewer tubes need to be bent back to get the largest size access door opening.

The sealed, insulated door in accordance with the invention has a stepped or tapered insulation plug for cooperating with and being cooled by the tubes in a tapered opening in a waterwall. The insulation plug is also preferably comprised of layers of different grades of insulation, thereby enabling cost to be reduced while meeting the high temperature requirements of such doors.

The door and associated frame according to the invention are constructed for fast, easy, and accurate guiding and mounting in gas-tight relationship to the tubes of the opening in the water wall, while at the same time providing a space for insulating between the tubes and the door frame.

Further, the door of the invention has a spring-biased flexible plate door assembly for preventing damage to the door seal by inadvertent operation of the door opening and closing mechanism and/or opening and closing movement of the door when the parts are not in proper operative position for opening and closing the door.

In one embodiment, a protective metal cover or sheath is provided on the insulation plug to protect it from highly abrasive or corrosive environments and/or mechanical damage, and the sheath incorporates expansion joints between adjoining sections of the cover, with telescoping retainer tabs arranged to maintain the sheath sections in properly aligned relationship with one another.

The door of the invention is shipped in a packing case or carton which protects the insulation during shipment and handling, and which may also be used as a temporary protective device when the door is opened or removed from its opening after installation.

These and other objects and advantages of the invention are achieved in accordance with the invention by the various disclosed embodiments of a door assembly for high temperature, gas-tight applications. In accordance with the invention, a cut-out opening is made in the boiler tubes of a waterwall, and a mating panel assembly is constructed with boiler tubes bent to form an access opening, the tubes ends of which may be connected with the cut tubes in the waterwall In one embodiment, the panel assembly defines a tapered access opening defined by a plurality of boiler tubes arranged to provide one or more tapered sides for the opening. A door having a stepped or tapered insulation plug is assembled to the panel assembly for sealing cooperation with the tubes in the tapered sides of the access opening.

In a preferred embodiment, a door plate is supported by one or more horizontal yokes hingedly mounted on a frame plate attached in the opening in the waterwall. Mechanisms on the yokes have means for moving the door into and out of the access opening to provide a tightness between the insulation plug and the boiler tubes in the tapered opening in the waterwall to assure optimum heat insulation. The moving of the door plate against the frame plate mounted on the panel will also engage and compress a special sealing gasket to assure a gas-tight seal during operation. A flexibly mounted door sealing plate is carried by the door and includes yieldable biasing means to impose a preload on the plate to prevent opening and closing movement of the door when the operating mechanism is not in the proper operating position. This door is constructed with a latch pin which cannot be pulled out by the bare hands if there is outward pressure on the door and its yokes. This design makes it possible to provide a door that will be fast and easy to open throughout the life of the door.

According to another aspect of the invention, the space surrounding the cooling tubes that have been deformed to form an access opening through the waterwall is filled with insulation, and fins are provided on the tubes, extending into the space between the tubes to prevent disintegration and movement of the insulation out of the space.

None of the prior art high temperature door constructions known to applicant, including the structures described in U.S. Pat. Nos. 4,574,973 and 4,685,586, have any comparable stepped or tapered insulation plug for cooperation with the tubes in a tapered opening in a waterwall. Neither is there any prior art showing the guide angle and associated structure for fast and easy guiding and securing of the door frame directly and gas-tight in the opening in the water wall while keeping a space for insulation, etc. to minimize the heat transfer to the outside parts of the door. Likewise, there is not any suggestion of the spring-biased flexible plate door assembly for preventing damage to the seal by inadvertent operation of the door opening and closing mechanism and/or opening and closing movement of the door when the parts are not in proper operative position for opening and closing the door. And, further, neither the protective metal sheath with interengaged telescopic tabs, nor the dual purpose shipping case are disclosed in the prior art. Other features found in the door capability and associated changeable sag rod.

BRIEF DESCRIPTION OF THE DRAWINGS

The foregoing, as well as other objects and advantages of the invention, will be apparent from the following detailed description when considered in conjunction with the accompanying drawings, wherein like reference characters refer to like parts throughout the several views, and wherein:

FIG. 12 is a rear view in elevation of the frame plate used with the door of the invention, showing the guides and spacers that are used for accurately guiding and positioning the door assembly in an opening in a waterwall;

FIG. 13 is an enlarged fragmentary sectional view taken along line 13—13 in FIG. 12;

FIG. 19 is a partially broken away front elevational view of a lower portion of the panel section shown in FIG. 6;

FIG. 20 is a longitudinal cross sectional view of the panel section and door assembly of FIGS. 4–6, taken along line 20—20 in FIG. 5, and with a door shown in section in the bottom half of the figure for illustrative purposes;

FIG. 51 is a longitudinal sectional view of a door according to the invention, with a protective packing case in position for shipping the door;

FIG. 52 is a transverse sectional view of the door and packing case of FIG. 51.

DETAILED DESCRIPTION OF THE PREFERRED EMBODIMENTS

Figure 1:
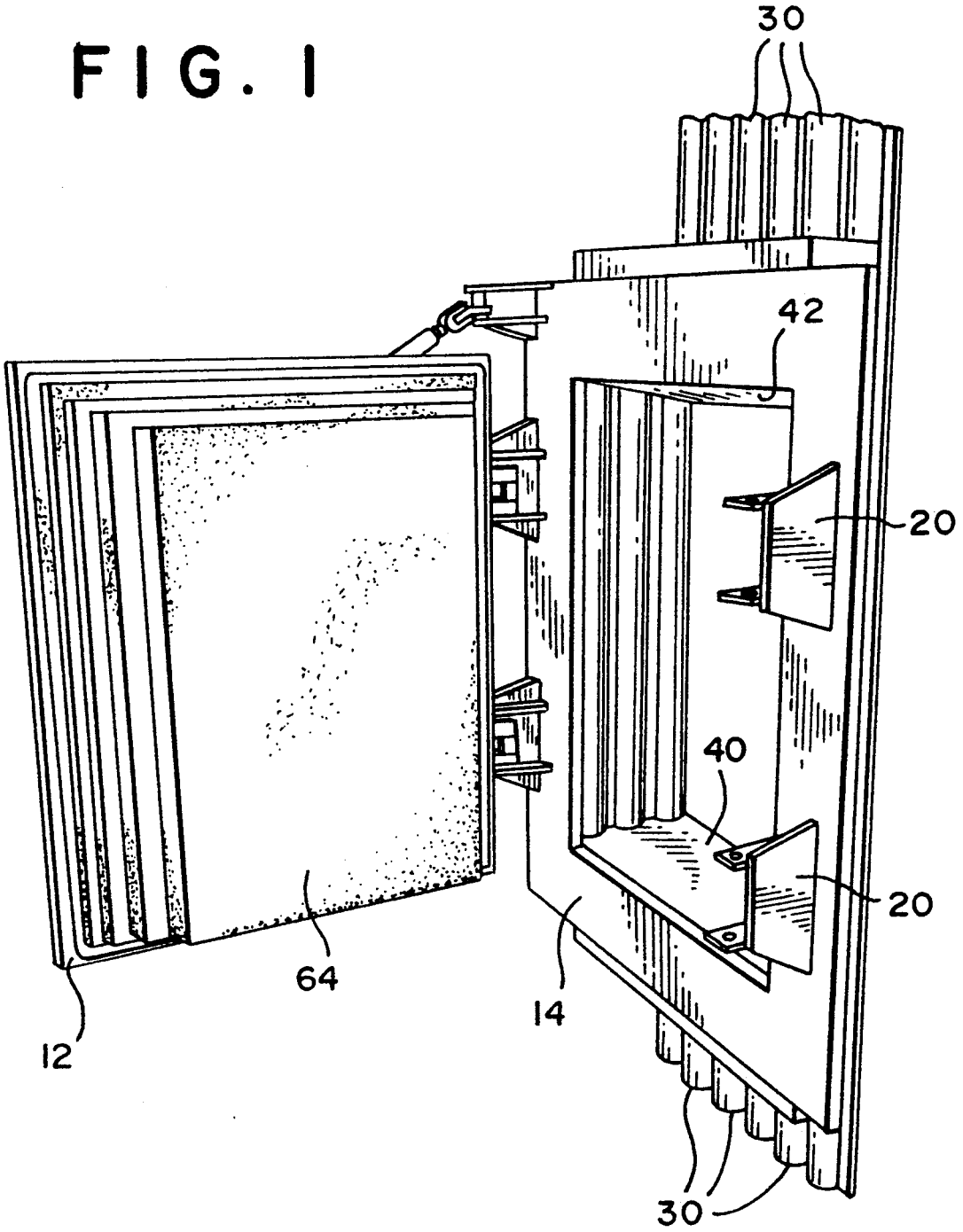
FIG. 1 is a front perspective view of a door and panel assembly according to the invention.
Figure 3:
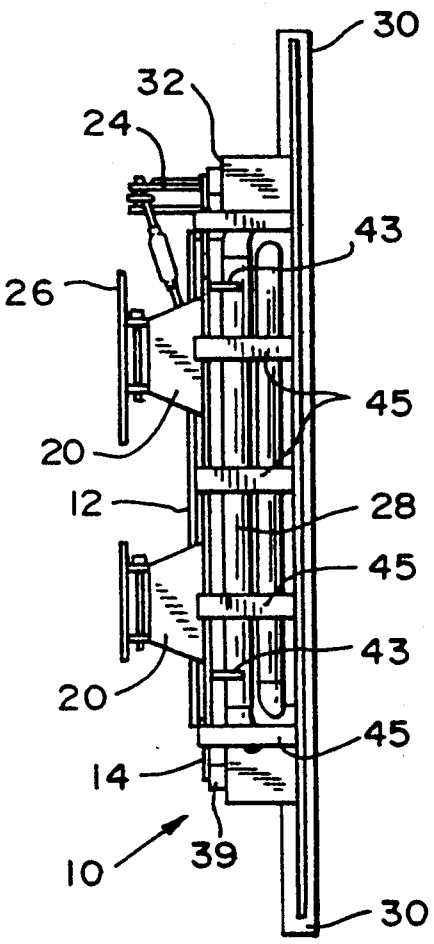
FIG. 3 is a side elevational view of the door and panel assembly, as viewed from the right hand side of FIG. 2.

The door installation according to the present invention is for high temperature applications requiring insulation and a gas-tight seal. One example of such a high temperature application is a boiler access door, where the door may be exposed to the very high temperature of hot gasses and radiant heat, which may approach 3000° F. Various embodiments of such a high temperature door are shown in detail in the drawings.

One embodiment of a door installation 10 in accordance with the invention is shown in FIGS. 1 through 22, and comprises a flexibly mounted door plate 12 hingedly supported on a frame plate 14 by a pair of horizontal yokes 16. The horizontal yokes 16 are pivotally supported at one of their ends from one side of the frame plate 14 by hinges 18, and cooperate with latch pin locking arrangements 20 at their opposite ends to maintain the door in closed position.

A door sag rod 21, including an adjustment turnbuckle 22, is connected between a bracket 24 at an upper left hand corner of the frame plate 14 and the upper yoke 16 to prevent the door from sagging over time.

The door plate 12 is mounted on the yokes 16 by screw jacks 23 connected to handles 26. The door plate carries a peripheral sealing gasket 11 mounted in a channel 13 on the rear face of the door plate, for sealing engagement against the frame plate 14 to prevent hot gasses from escaping between the door and its frame. By turning the handles 26, the door plate and yokes are forced apart, and the reaction between the yokes and their associated mounting hinges and latch pins causes the door plate and the sealing gasket carried thereby to be pressed firmly into engagement with the door frame. This structure and its function are more fully explained in U.S. Pat. Nos. 4,574,973 and 4,685,586.

However, it is possible with the prior art structure to move the door toward or away from its closed position when the door plate and its associated sealing gasket are not properly opened position. As a result, the sealing gasket can be damaged by shear force against the frame plate. This problem is particularly acute if the handles 26 are moved in a closing direction after the door has been opened, but before it is pivoted into closed position in the access opening. In such event, the door plate and yokes would be moved relatively apart, causing the spacing between the door plate and frame plate to be too close during final closing movement of the door for interference-free closing movement of the door.

Figure 48:
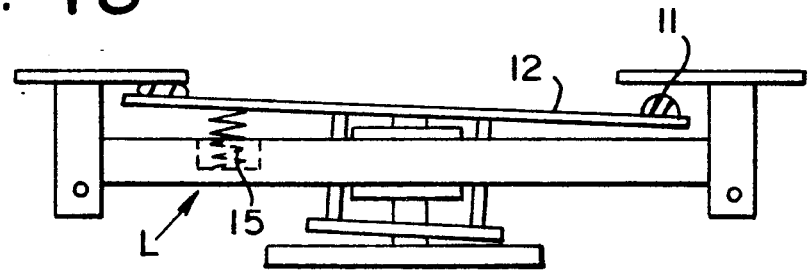
FIG. 48 is a schematic illustration of a door in accordance with the invention, wherein a preload spring is engaged between the door plate and yoke assembly to prevent opening of the door and potential damage to the seal when the door is not properly positioned for opening.
Figure 49:
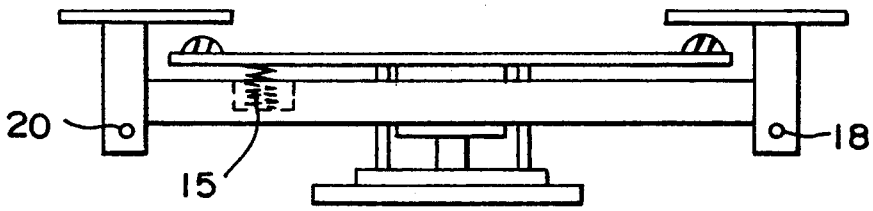
FIG. 49 is a schematic illustration of the door of FIG. 48, with the preload spring collapsed to permit opening of the door.
Figure 50:
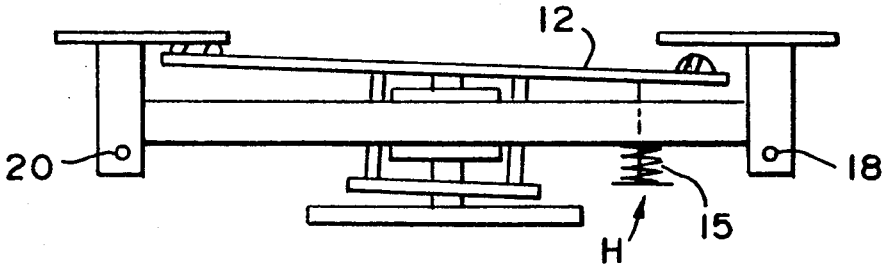
FIG. 50 is a schematic illustration of a variation of the door of FIG. 48, with the preload spring placed differently.

In the present invention, a preload spring 15 (FIGS. 40–50) acts between the door plate and yokes to exert a biasing force between the door plate and yokes and thereby place a frictional load on the latch pins, preventing their removal and thus preventing opening movement of the door. This, in turn, prevents damage to the sealing gasket by inadvertent interference between the gasket and frame plate. As seen in FIG. 48, the spring is provided on the latch pin side of the door, while in FIG. 50 it is on the hinge pin side. In the form shown in FIG. 48, the spring acts directly between the door plate and yoke on the same side as the latch pins; while in the form shown in FIG. 50, the spring acts through a link to pull the side of the door plate adjacent the hinge pins toward the yoke, pivoting the door plate about the screw jack to press the latch pin side against the frame plate.

Figure 2:
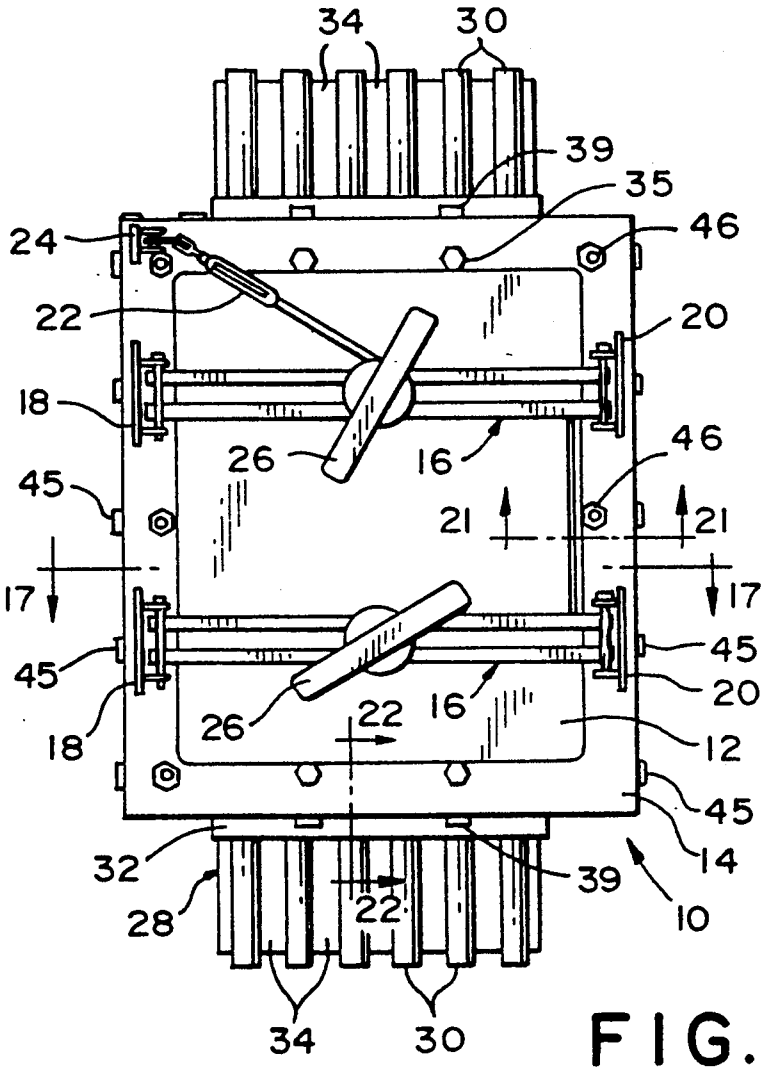
FIG. 2 is a front elevational view of the high temperature door assembly of FIG. 1.

The assembly including the door plate 12, frame plate 14 and the hinge and locking mechanisms are mounted as a unit on a panel section 28. The panel section 28 is constructed of boiler tubes 30 and mounting plate 32. The boiler tubes can be assembled with membrane sections 34 therebetween, as shown in FIG. 2. Alternatively, the boiler tubes can be butted one against the other, and/or a continuous outer casing may cover the cooling tubes to form a gas-tight enclosure.

The panel section 28 is mounted in a cut-out opening in a waterwall during installation, with the cooling tubes 30 of the panel section 28 being welded to the corresponding boiler tubes of the water wall. The detailed structure of the panel section 28 will be described below and is shown in detail in FIGS. 4–22.

Except for the preload spring 15, and the novel features described hereinafter, the above-described door structure, including the frame plate 14, yokes 16, hinges 18, latch pin locking arrangements 20, turnbuckle 22, bracket 24 and handle 26 are the same or similar to that shown and described in U.S. Pat. No. 4,574,973 issued on Mar. 11, 1986 to Lewis, Jr. et al. and U.S. Pat. No. 4,685,586 issued on Aug. 11, 1987 to Lewis, Jr. et al., both references being incorporated herein. However, the panel section 28 and frame plate 14 of the present invention have novel features, including the preload spring, which makes installation of them in a waterwall opening a quick and easy procedure, as more fully described hereinafter.

Figure 6:
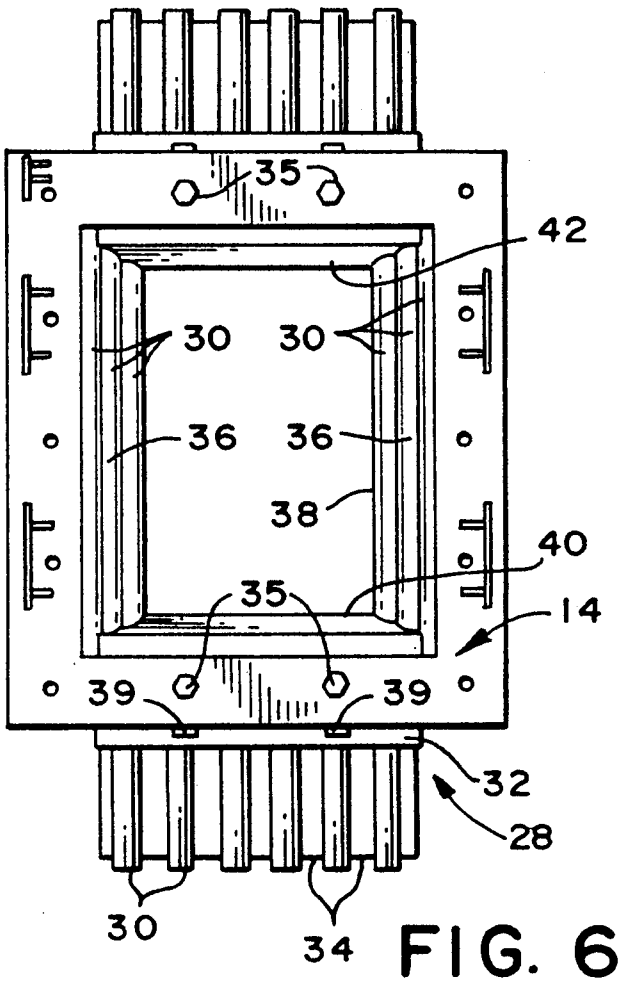
FIG. 6 is a front elevation view of the panel section shown in FIG. 5, with a door frame plate installed thereon.
Figure 5:
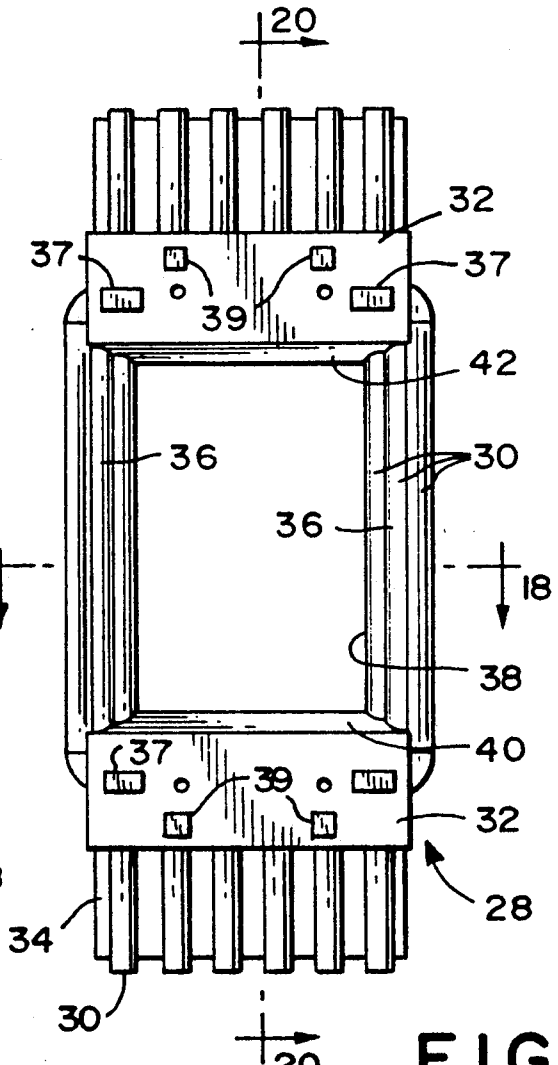
FIG. 5 is a front elevational view of the panel section of the door as shown in FIG. 4.
Figure 4:
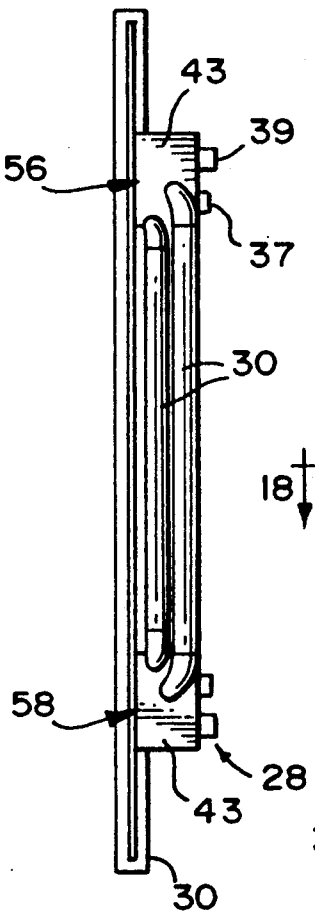
FIG. 4 is a left side view of the panel or frame section of the door assembly, with bent out tubes forming a tapered opening.
Figure 7:
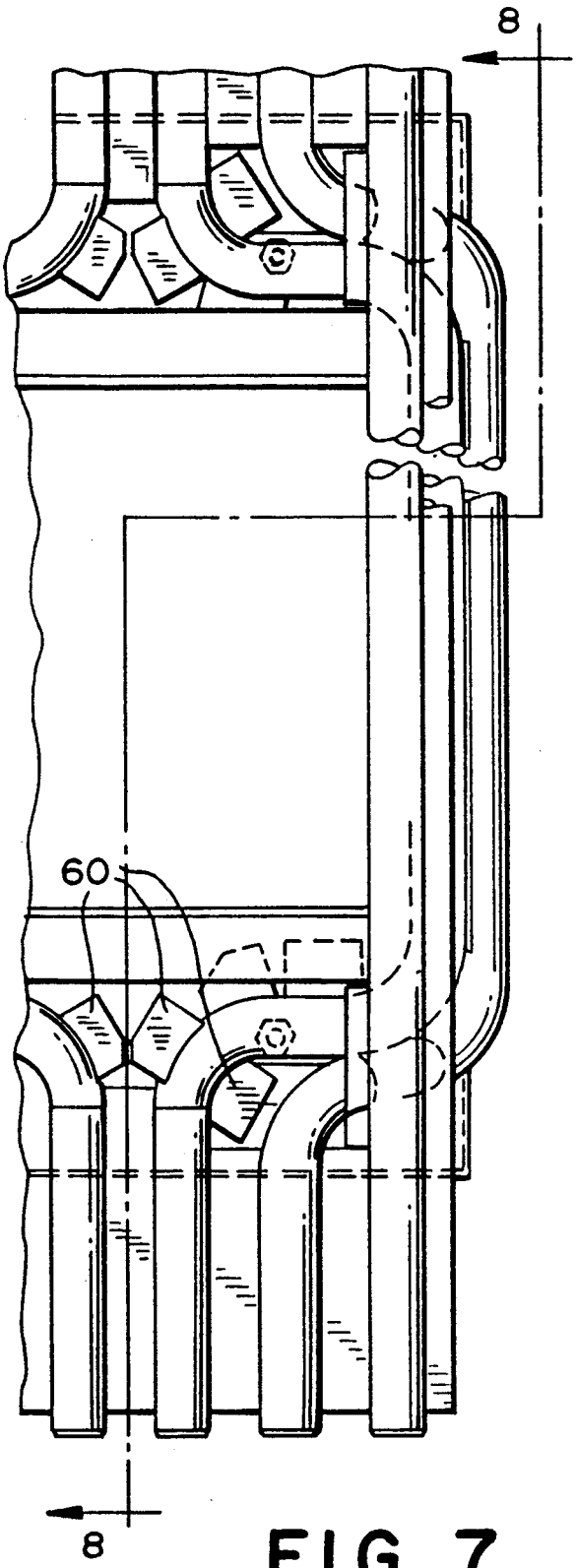
FIG. 7 is a partial rear view in elevation of the boiler tube panel shown in FIG. 5.
Figure 8:
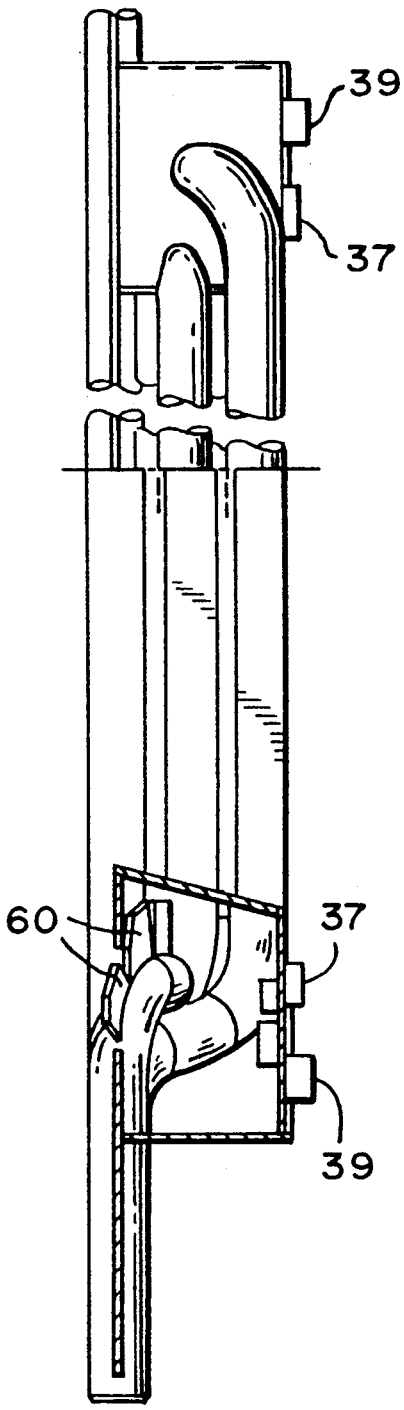
FIG. 8 is a sectional view taken along line 8—8 in FIG. 7.
Figure 9:
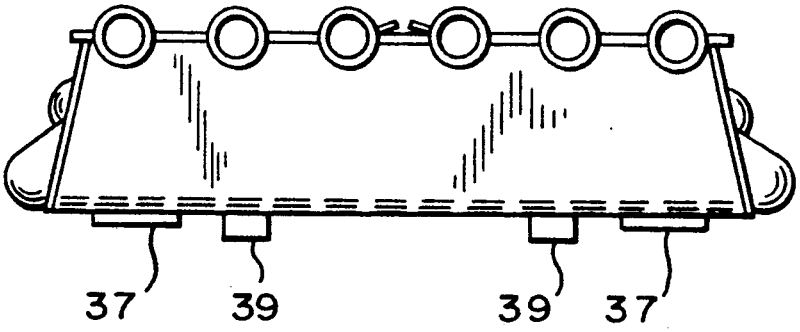
FIG. 9 is a top plan view of the panel of FIG. 8.
Figure 10:
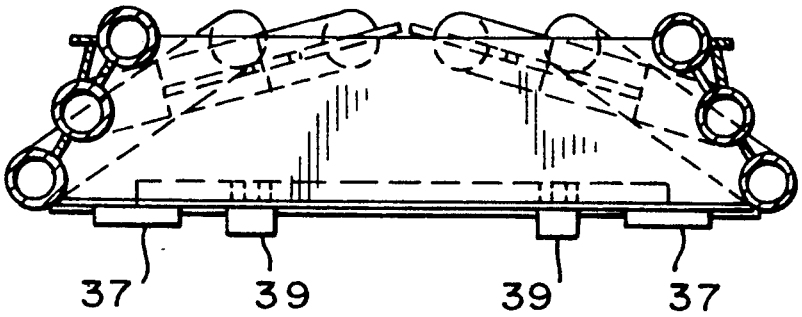
FIG. 10 is a transverse sectional view taken along line 10—10 in FIG. 11.
Figure 11:
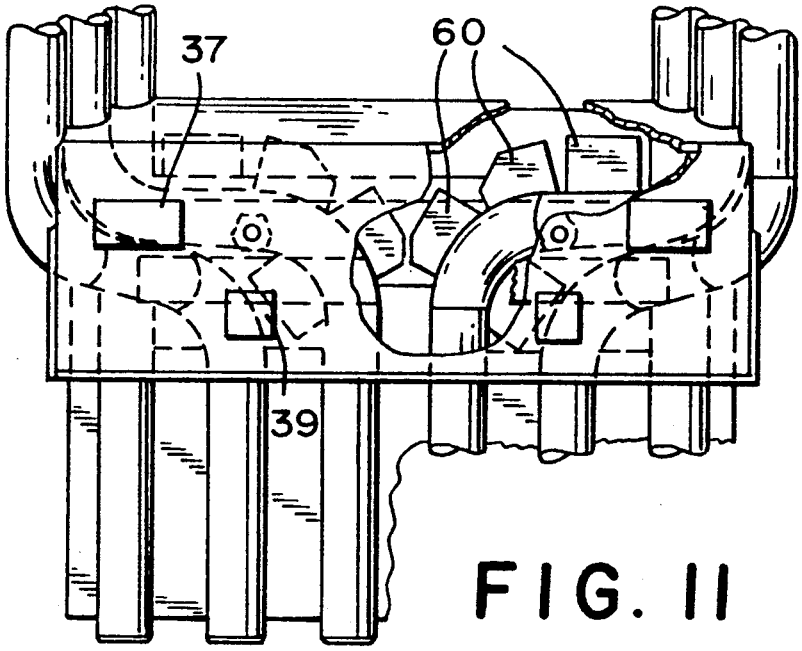
FIG. 11 is a partial front view of the bottom portion of the panel of FIGS. 4–8.
Figure 15:
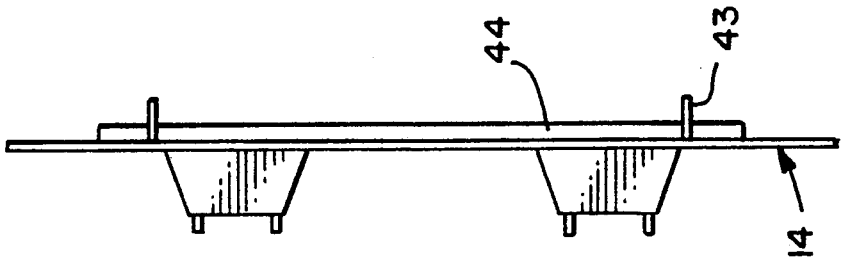
FIG. 15 is a side view in elevation of the assembly of FIG. 14.
Figure 14:
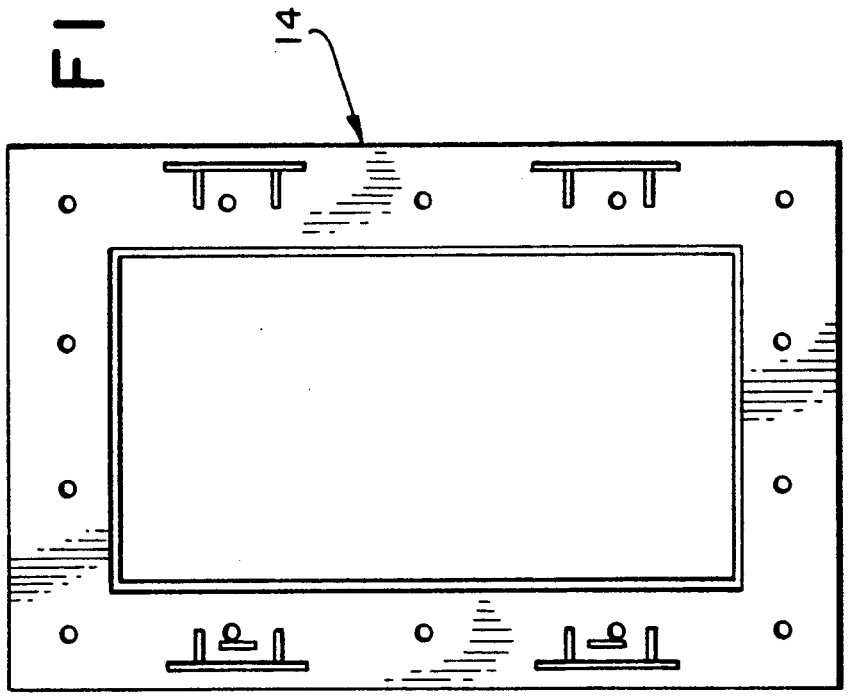
FIG. 14 is a front view in elevation of the door frame assembly used in the invention, showing the symmetrical configuration which permits easy changes from right-hand to left-hand doors.
Figure 16:
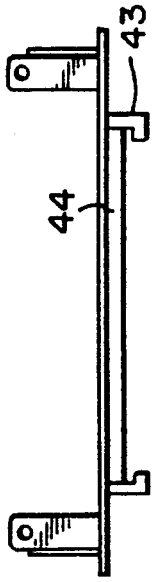
FIG. 16 is a bottom view in elevation of the door frame assembly of FIG. 14.

The panel section 28 is basically constructed of lengths of boiler tubes 30, some of which are bent out to form the door opening and also bent outwardly from the plane of the waterwall when installed. The panel section includes outer end boxes 56 and 58 fabricated out of steel plate to form enclosures and mounting areas for the door frame plate 14. The cooling tubes 30 are bent and arranged so as to define tapered sides 36 of access opening 38, as shown in FIGS. 5, 6 and 10, for example. The tapered opening 38 is further defined by tapered sill 40 and tapered header 42 and their reinforcing bars 48. These elements are made from heat resistant metal plate, and are part of the end boxes 56 and 58. Portions of the boiler tubes 30 are covered by the end boxes 56 and 58, which include the mounting plates 32 above and below the tapered access opening 38. The end boxes 56 and 58 are welded gas-tight to the other parts of the panel 28.

The frame plate 14 is bolted with bolts 35 to the mounting plate 32, and is supported and aligned by spacer blocks 39 and guide blocks 37, which greatly facilitate ease of assembly. See FIGS. 5, 6 and 8–11, for example.

Further details of the panel sections and door structures are shown in FIGS. 7–22. In the top cross-section of the door installation 10 shown in FIG. 17, the tapered arrangement of the boiler tubes is clearly shown. The positions of the boiler tubes of the waterwall are shown in ghost lines as a single plane or linear arrangement. The boiler tubes 30 of the panel section 28 are shown as being bent outwardly from the plane of the waterwall and connecting into the boiler tubes of the waterwall at a lower portion of the panel section 28. Further, the membrane sections 34 are also shown defining gas tight tapered sides 36 of the tapered access opening 38. FIG. 18 further reveals the arrangement of the boiler tubes 30 in the panel section of the door assembly with respect to the boiler tubes of the waterwall.

FIGS. 13, 17, 21 and 22 also reveal a spacer angle 44 extending from the frame plate 14 for engagement against the outermost boiler tube 30 on the tapered sides 36 of the opening 38 in the waterwall to properly space and position the panel with respect to its depth of insertion into the opening. Further, a gasket 41 is provided on the spacer angle for sealing against the boiler tube 30 to form a seal.

In FIG. 20, the spacer angle 44 can be seen with the gasket 41 sealing against the mounting plate 32, which is part of the lower end box 58. FIG. 20 does not show this identical assembly for the upper end box 56.

The lower portion of FIG. 20 also shows how the guide blocks 37 and the spacer blocks 39 support the spacer angle 44, which is part of the frame plate 14 (see FIGS. 12, 13, 21 and 22).

FIGS. 3, 12 13 21 and 22 also show the side guides 43 which are attached to the back of the frame plate 14 and which guide the frame plate into the opening in the waterwall during installation of the panel section 28. The guide blocks 37, side guides 43 and spacer angle 44 will assure that the door assembly is positioned accurately in the tapered opening in the waterwall, and by engaging the adjacent tubes 30 during installation, automatically guide the panel into place.

The spacer angle 44 stops the extent of insertion of the door and panel assembly into the opening in the waterwall by engaging against the outermost boiler tube, and providing a predetermined space for insulation between the frame plate and boiler wall (see FIG. 21), while the side guide 43 locates against the side of the tubes 30.

Figure 17:
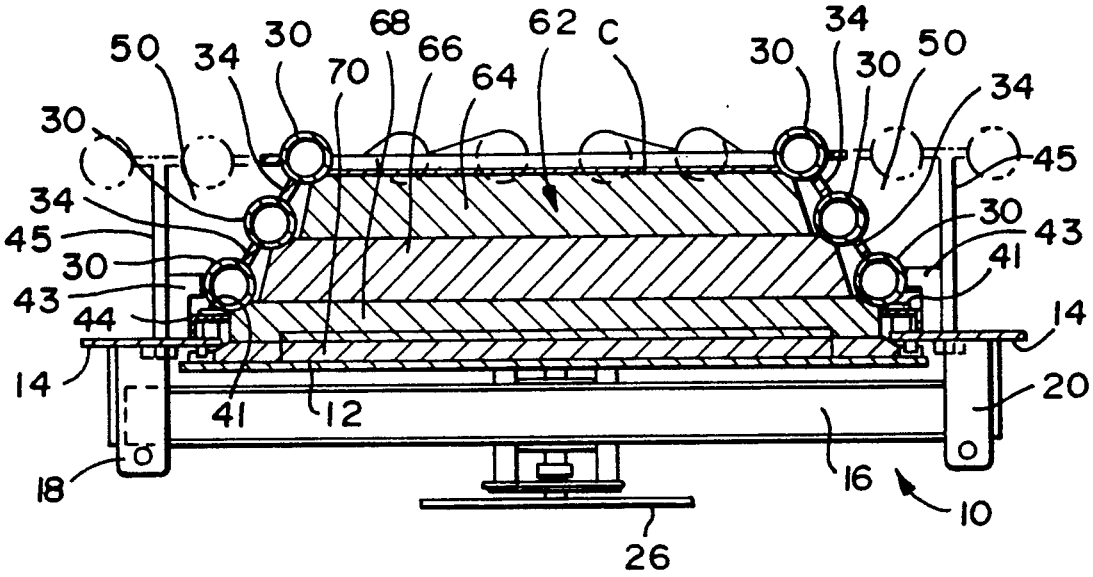
FIG. 17 is a transverse cross-sectional view of the door assembly of FIGS. 1 and 2 taken along line 17—17 in FIG. 2.
Figure 18:
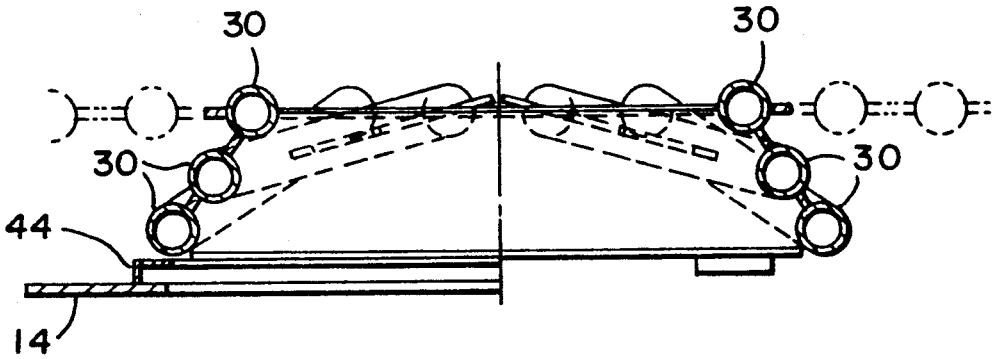
FIG. 18 is a transverse cross-sectional view of the panel of FIGS. 4–6, taken along line 18—18 in FIG. 5.

To diminish heat transfer from the outermost boiler tubes 30, insulation I (see FIG. 22, for example) is filled in the spaces between the frame plate 14 and the mounting plates 32, and also behind the boiler tubes 30 in the areas 50 and 51 shown in FIGS. 17 and 20. Further, stays or spacer bars 45 and stay bolts 46 extend outwardly from the face of the waterwall for securing the frame plate 14 to the waterwall, with spacer angle 44 in tight, sealing engagement against the outermost boiler tubes 30 and mounting plates 32. See FIGS. 3, 21 and 22.

Figure 22:
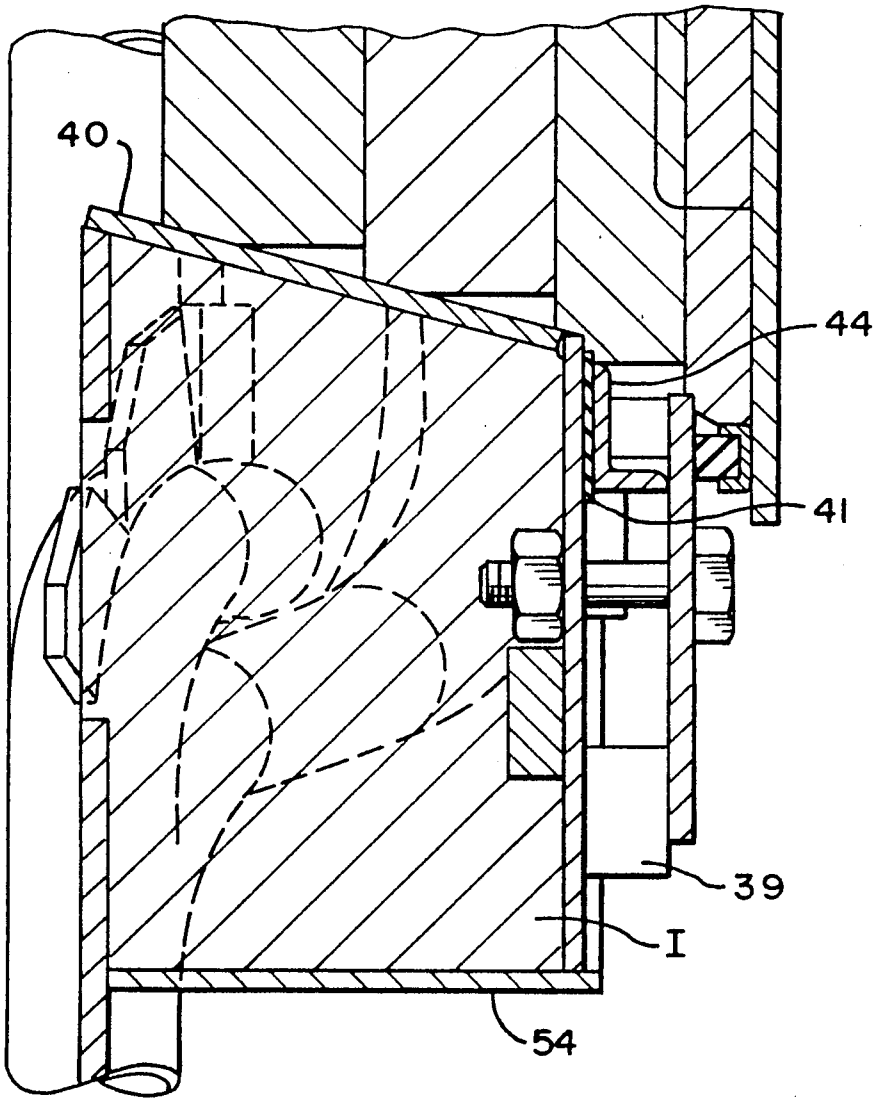
FIG. 22 is an enlarged, fragmentary sectional view taken along line 22—22 in FIG. 2.

FIGS. 20 and 22 reveal the end boxes 56 and 58 with the tapered sill 40 and tapered header 42. An upper sealing member 52 and a lower sealing member 54 extend between the mounting plate 32 and the assembly of boiler tubes 30 and membrane sections 34 to form a gas-tight seal. These sealing members are typically fabricated from steel plate by cutting and welding. The end boxes 56 and 58 are filled with castable insulation or ramming mix before the side plates 43 are seal-welded to the end boxes 56 and 58. See FIGS. 4 and 22.

The boiler tubes 30 passing through the upper and lower end boxes 56 and 58 are provided with retaining fins 60, for example, in the form of a plurality of small rectangular plates welded to and extending from the boiler tubes into these compartments, as shown best in FIGS. 7–11, 19 and 22. The retaining fins hold pieces of the ramming mix within the compartment as the ramming mix deteriorates over time, cracking into discrete chunks or pieces of material. Otherwise, these chunks could fall from these compartments into the waterwall enclosure and diminish the efficiency of the insulation, which is necessary to protect the exterior steel portions of the end boxes 56 and 58 from the very high temperatures. These openings around the boiler tubes 30 are unavoidable in the construction of the panel assembly with the boiler tubes being diverted to form the door opening in the waterwall.

One of the important features of the present invention is the tapered insulation plug 62 that is secured to the interior face of the door plate 12. In a preferred form, as shown in FIGS. 17, 20–22 and 40–42, the insulation plug comprises multiple layers 64, 66, 68, 70 of insulation. Preferably, the layers are of different grades, with the best grade as layer 64, which is subject to the highest temperatures, and a lesser grade being used for layer 66, and even a lesser grade being used for layer 68, etc.. This arrangement is at least partially dictated by cost savings considerations, i.e., the very high cost of these insulation materials, and especially the highest grades, makes it economically desirable to use them only in the area subjected to the highest temperature. However, it is conceivable that in some applications the same grade of insulation would be used for all layers.

Figure 24:
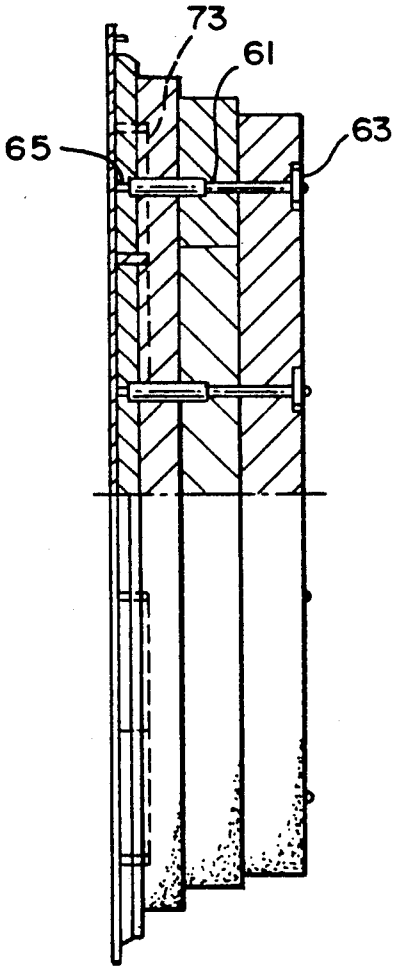
FIG. 24 is a partially sectional view taken along line 24—24 in FIG. 23.
Figure 25:
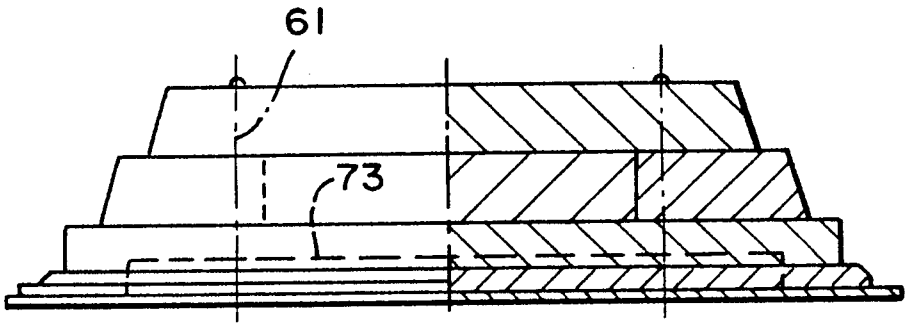
FIG. 25 is a partially sectional view taken along line 25—25 in FIG. 23.

The layers of insulation are preferably glued together, with ceramic pins and retainers 61, 63 (see FIGS. 23–25, for example) being used to retain the insulation plug 62 on the back of the door plate 12. More specifically, the pins are connected by metal mechanical fasteners 65 welded on the back of the door plate 12 or bolted through holes in the door plate 12. The opposite ends of the pins are adapted to accept the retainers 63, for example ceramic washers, for holding the layers of insulation on the back of the door plate 12.

Figure 21:
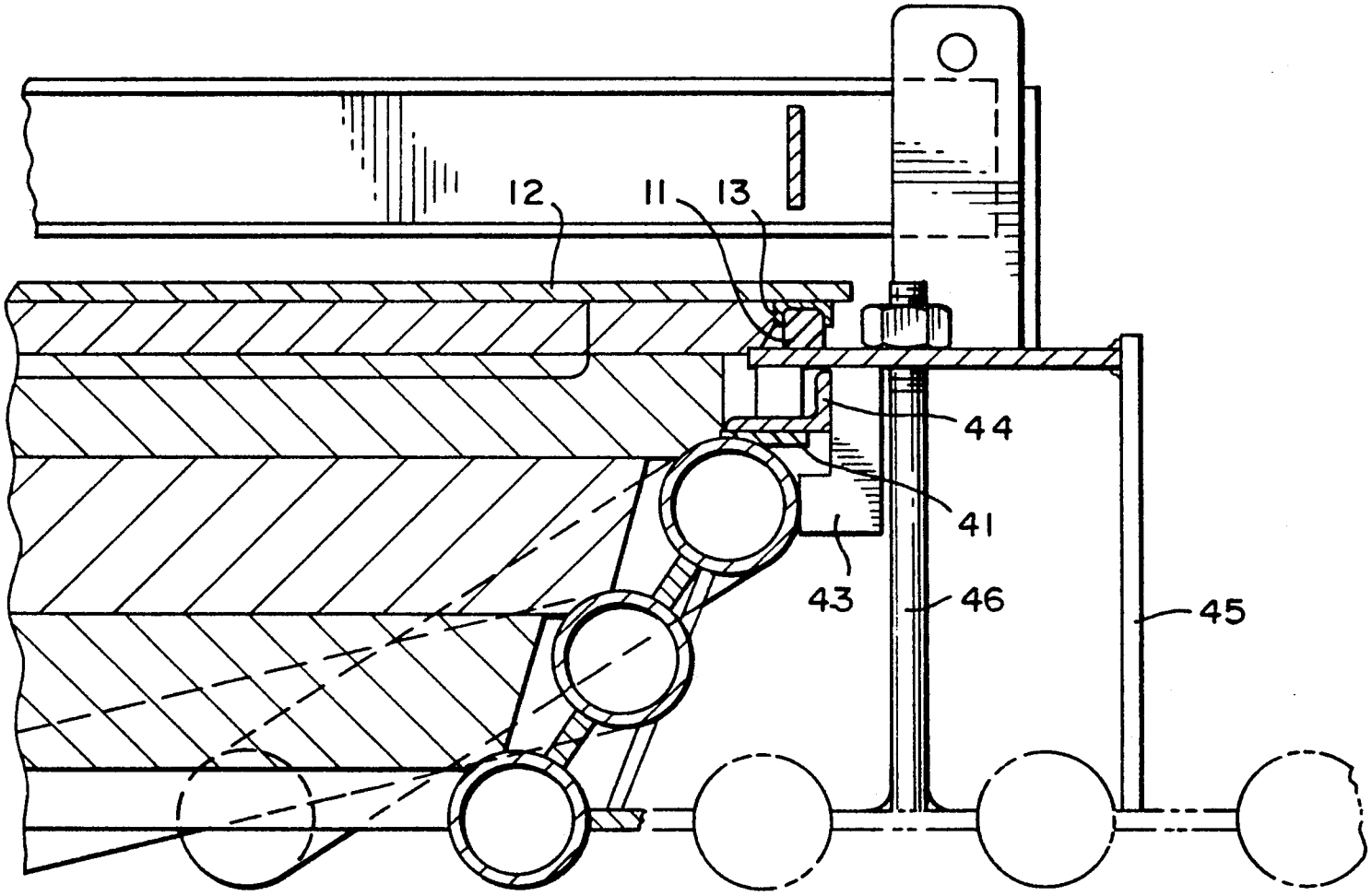
FIG. 21 is an enlarged, fragmentary sectional view taken along line 21—21 in FIG. 2.
Figure 23:
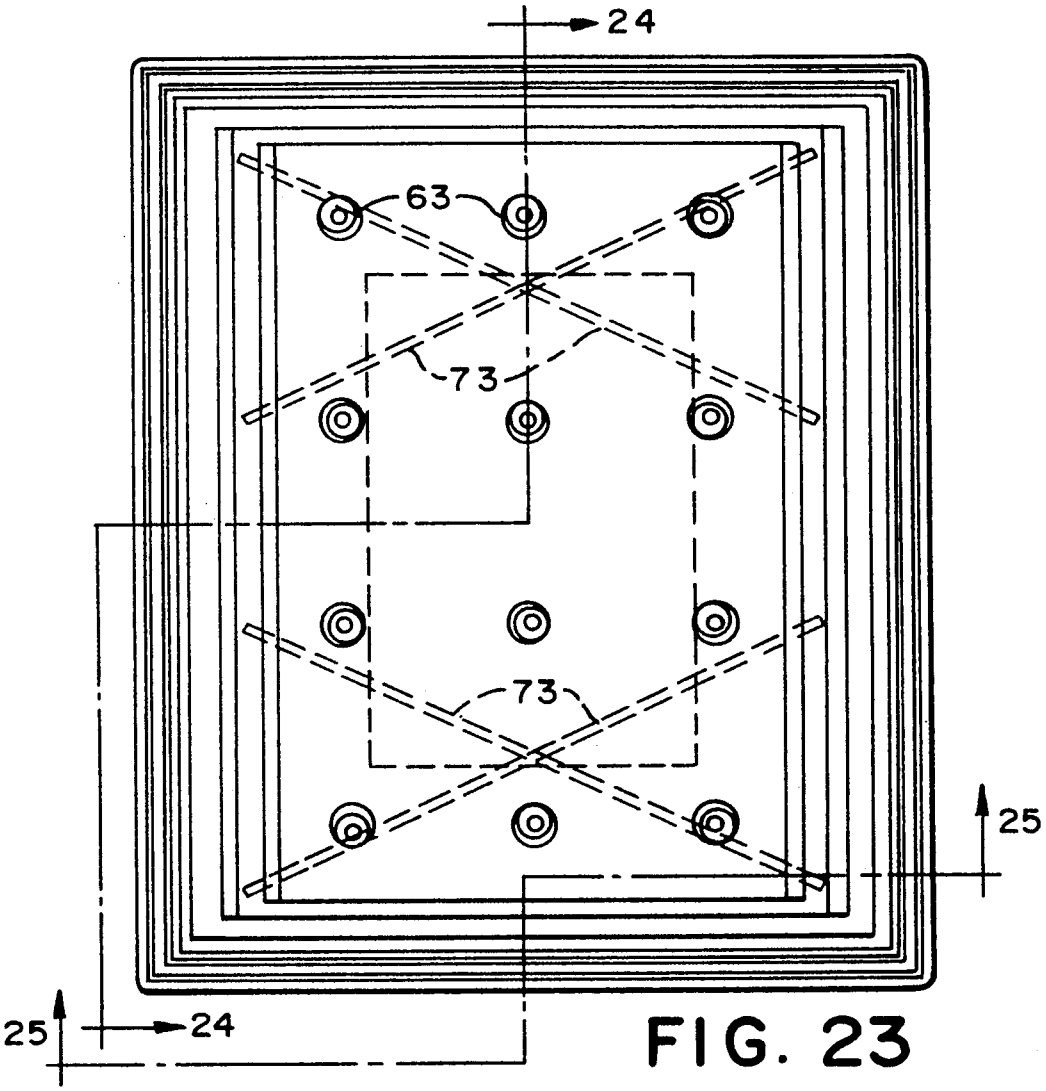
FIG. 23 is a rear plan view of an insulated door according to the invention, showing how the different layers of insulation may be attached to the door plate, and reinforced.

The insulation plug preferably has a stepped arrangement for providing multiple points of linear contact with the boiler tubes, as shown in FIGS. 17, 21 and 23, and with the tapered sill plate 40 and header plate 42.

The insulation material forming the insulation plug is a pliable material, at least at lower non-operating temperatures when the door would be typically opened or closed for maintenance operations on the door or waterwall enclosure. The pliable feature of the insulation material allows this material to tightly conform to the contact surfaces such as the outer surfaces of the boiler tubes 30 on the tapered sides 36 of the tapered opening 38 and with the outer surfaces of the tapered sill 40 and tapered header 42. This feature ensures multiple points of linear contact around the door perimeter, which ensures that the hot gasses will have difficulty penetrating toward the outer portion of the door while, at the same time, being cooled by the much lower temperature of the boiler tubes.

This cooling effect of the boiler tubes on the insulation material is another important feature of the invention, whereby the insulation is cooled substantially during operation of the boiler, etc., thus prolonging its useful life. The cooling action takes place from the outer periphery of the layers of insulation, inwardly toward the center thereof.

On the inner side of the innermost layer of insulation 64 of the insulation plug 62, there may be added a layer of troweled refractory cement C (see FIG. 17) which protects the mineral fiber insulation layer from the wear that could be caused by abrasive particulate material suspended in the gasses rushing past the waterwall.

As an alternative to the stepped arrangement, an insulation plug having straight, tapered sides (not shown) could be substituted and still provide multiple contact points with the surfaces of the boiler tubes 30. However, the surfaces of the tapered sill 40 and tapered header 42 would need to be modified, such as by providing a plural rib arrangement (not shown), to effect multiple point contact with such a tapered insulation plug.

As an alternative to this version, the sides of the insulation plug could be tapered and the top and bottom provided with a stepped arrangement (not shown) to provide multiple point contact all around the door structure with the same tapered access opening arrangement shown in the drawings.

As a further alternative version, the insulation plug could be made from a single body or layer of insulation 71 having tapered sides, top and bottom, (see FIGS. 28–34) or could be provided with a stepped arrangement, such as by cutting or machining a block of insulation.

Figure 26:
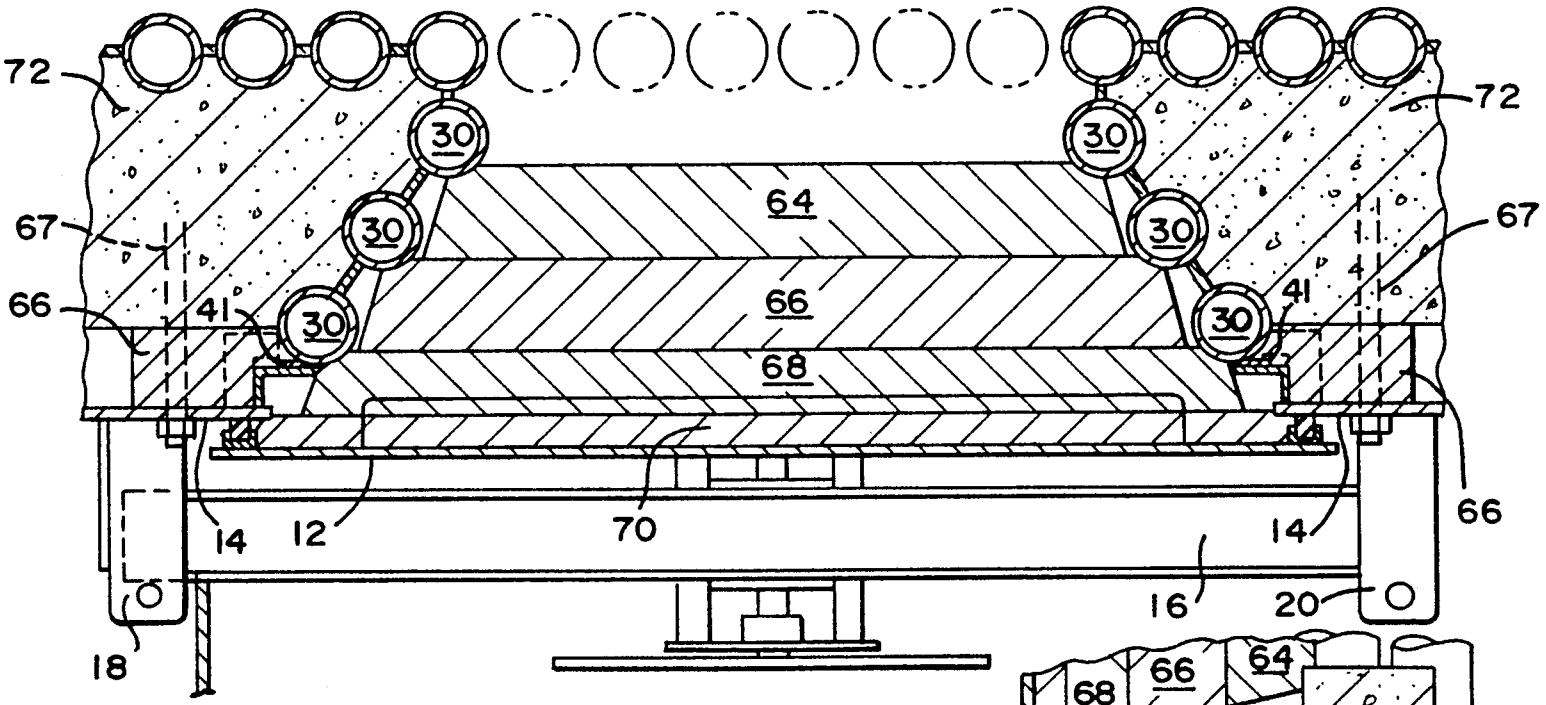
FIG. 26 is a transverse cross-sectional view of another embodiment of the door and panel assembly according to the invention, viewed from above, and in which the door frame comprises a cast-in-place structure.

A slightly modified form of the invention relative to that shown in FIGS. 1–22 is shown in FIG. 26. In this embodiment, the boiler tubes 30 are bent outwardly into the arrangement shown, followed by casting a door frame 72 of refractory material about the boiler tubes 30.

FIG. 26 also shows the gasket 41 compressed between the spacer angle 44 and outermost boiler tube 30 and mineral wool insulation 66, which has been stuffed behind the frame plate 14 to assure a thermal barrier. As seen in FIG. 26, the frame plate 14 is held by anchor bolts 67 embedded in the castable refractory around the door opening.

Figure 27:
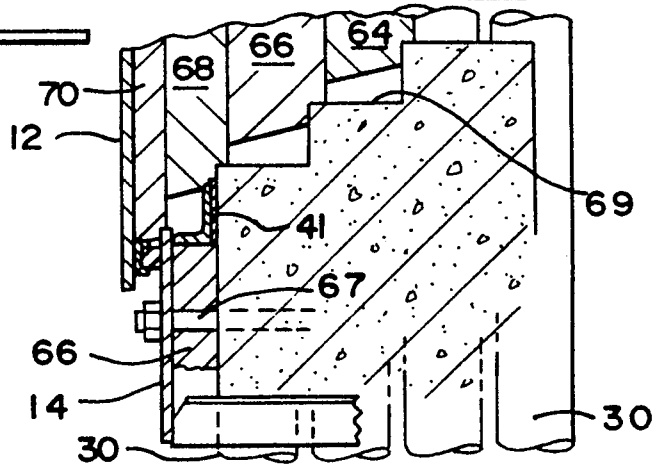
FIG. 27 is a transverse, fragmentary sectional view taken through the sill of a further variation of the door, in which the sill comprises a cast-in-place stepped structure.
Figure 30:
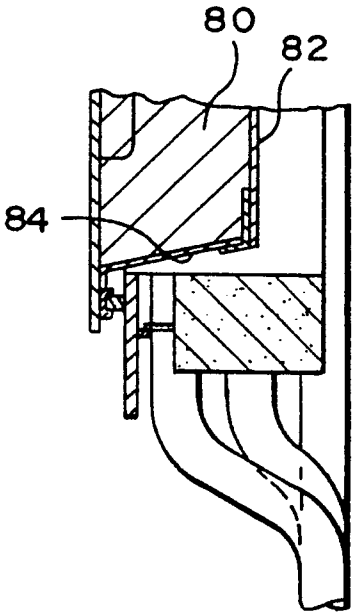
FIG. 30 is an enlarged, fragmentary, transverse sectional view of the sill and a portion of the door of the assembly of FIG. 28.
Figure 29:
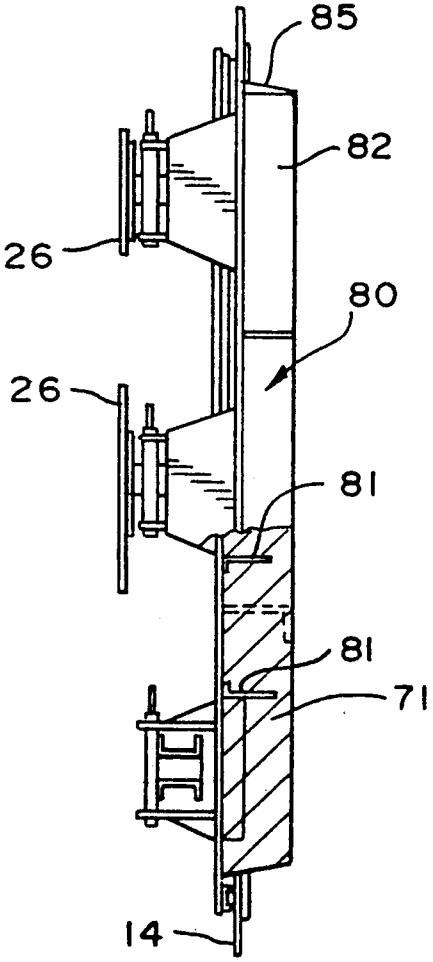
FIG. 29 is a side view of the door of FIG. 28, shown partly in section.
Figure 28:
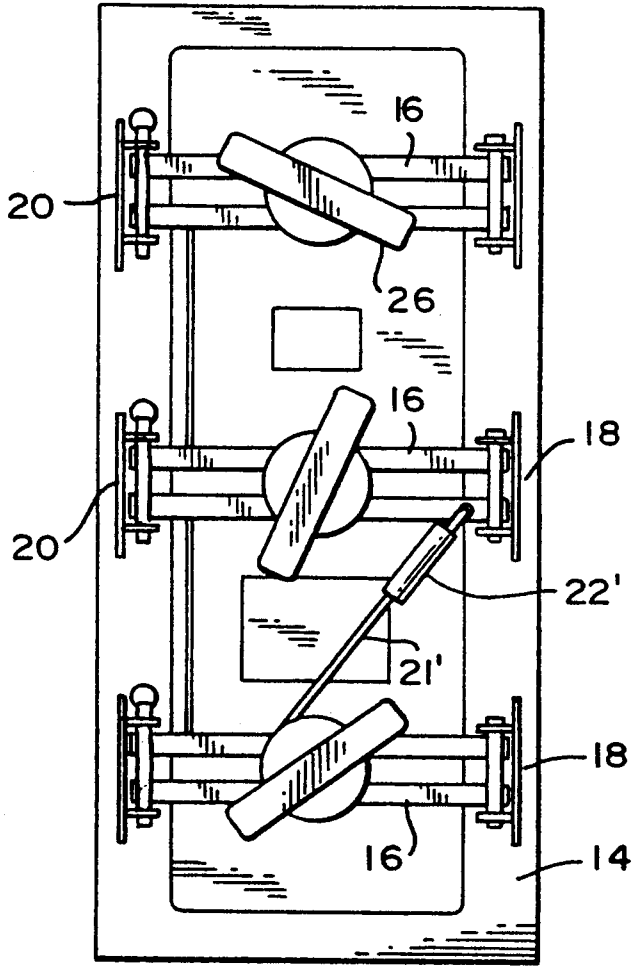
FIG. 28 is a front view in elevation of a modified door according to the invention, intended for larger access openings and having multiple yoke assemblies, and in which the insulation plug is of one piece and is protected by a protective metal sheath or pan.
Figure 31:
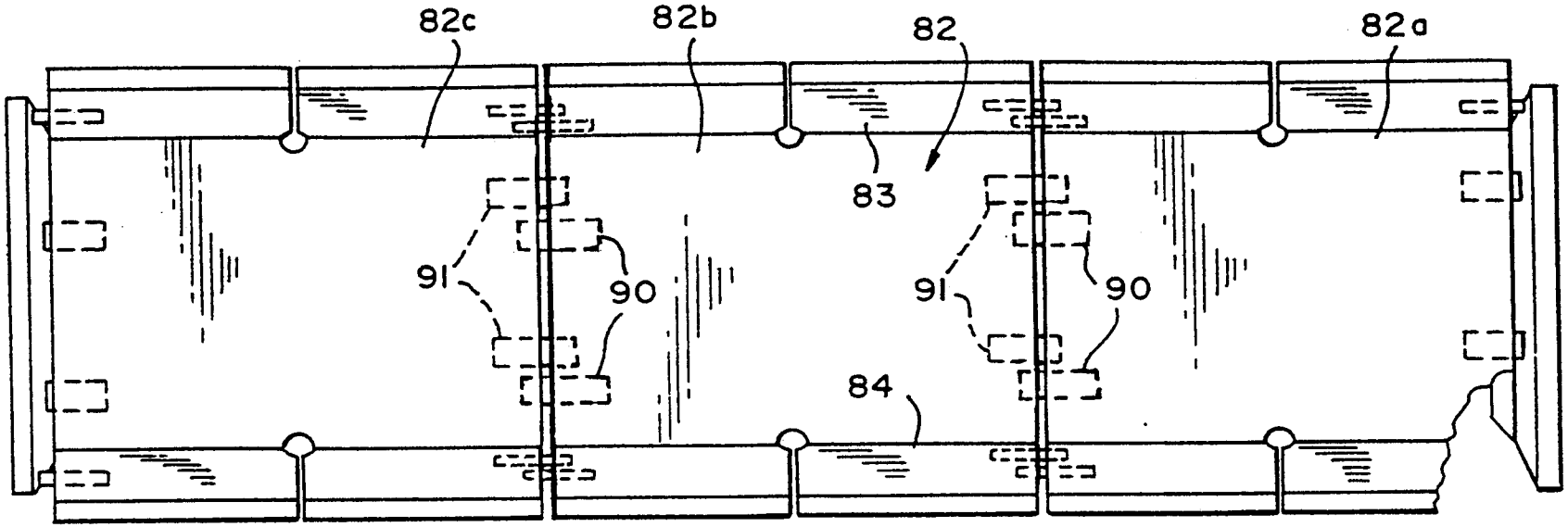
FIG. 31 is a rear plan view of the protective metallic sheath or pan used in the embodiment of FIG. 28.
Figure 32:
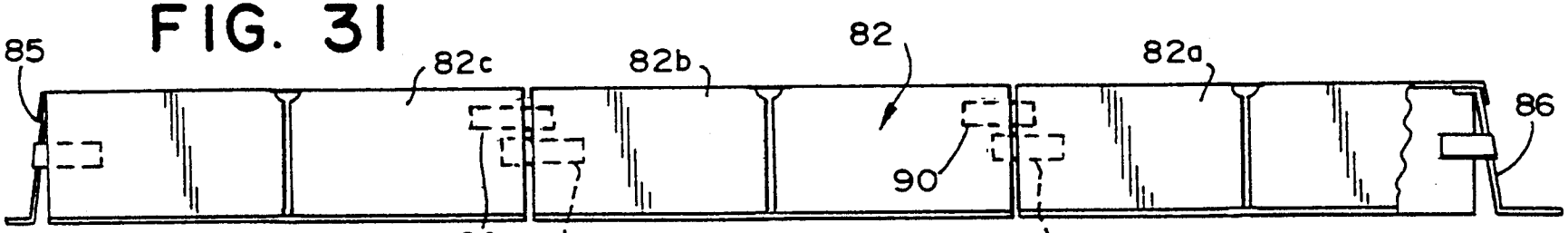
FIG. 32 is a side view in elevation of the sheath of FIG. 31.
Figure 33:
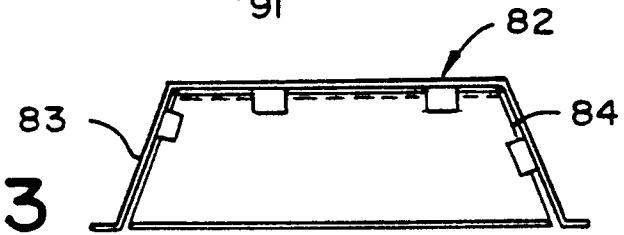
FIG. 33 is an end view of the sheath of FIG. 31.
Figure 34:
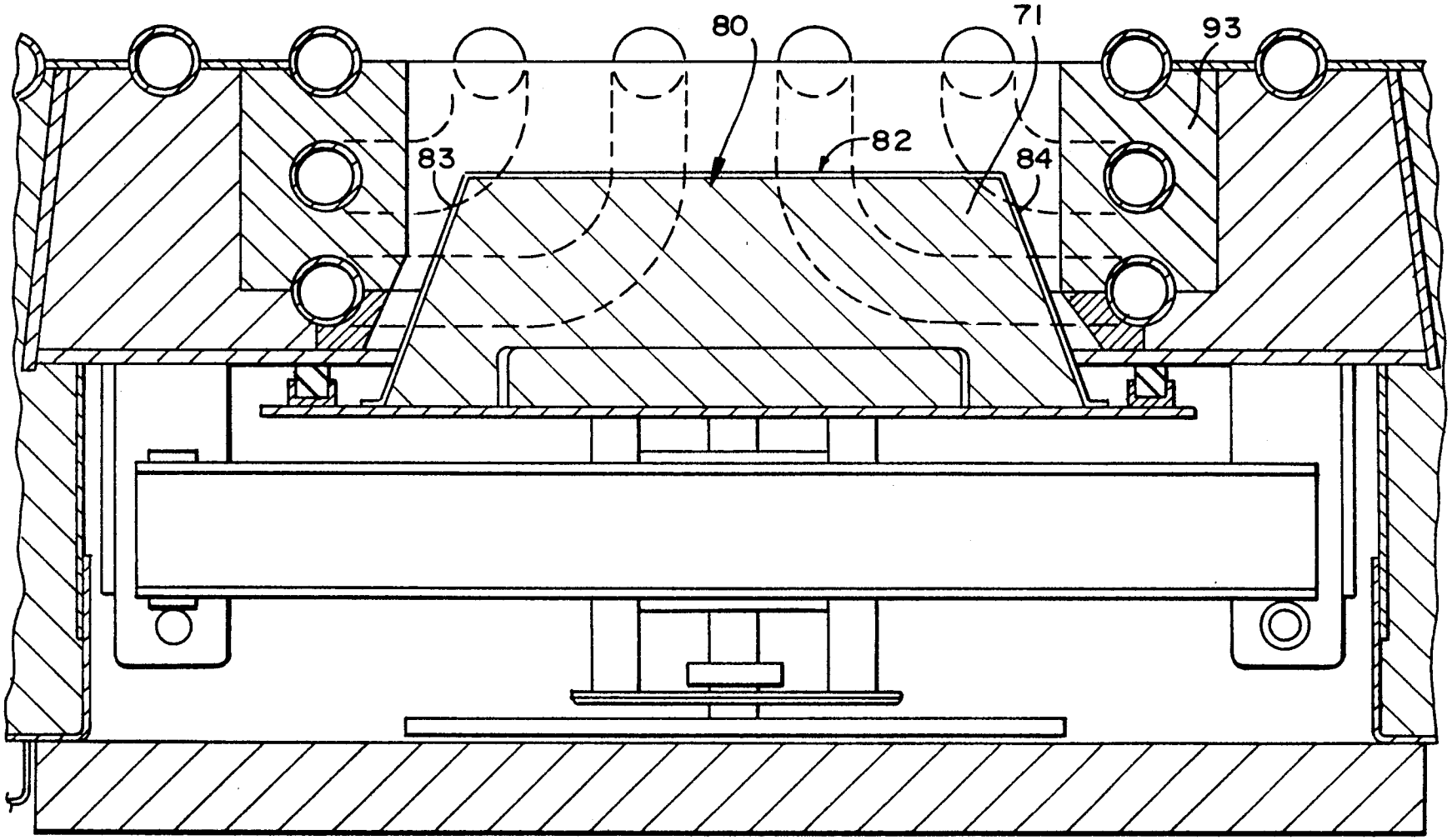
FIG. 34 is an enlarged transverse sectional view of the door assembly shown in FIG. 28.
Figure 37:
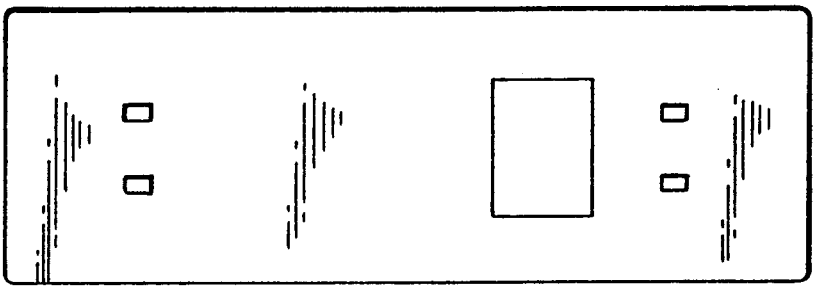
FIG. 37 is a front view in elevation of the door of FIG. 35.
Figure 38:
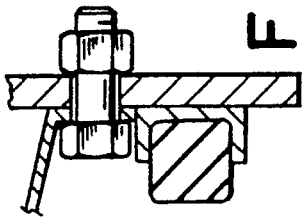
FIG. 38 is an enlarged sectional view taken along line 38—38 in FIG. 35.
Figure 36:
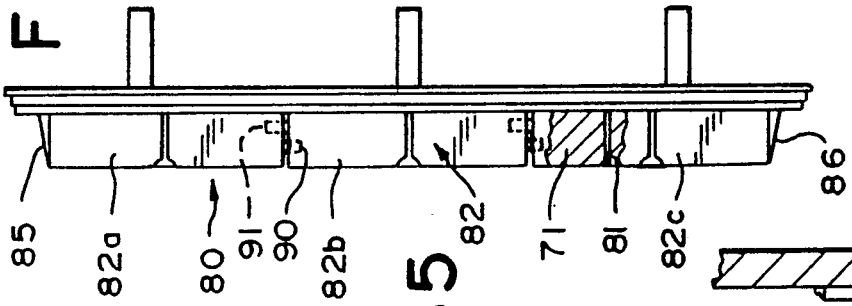
FIG. 36 is a side view in elevation of the door of FIG. 35.
Figure 35:
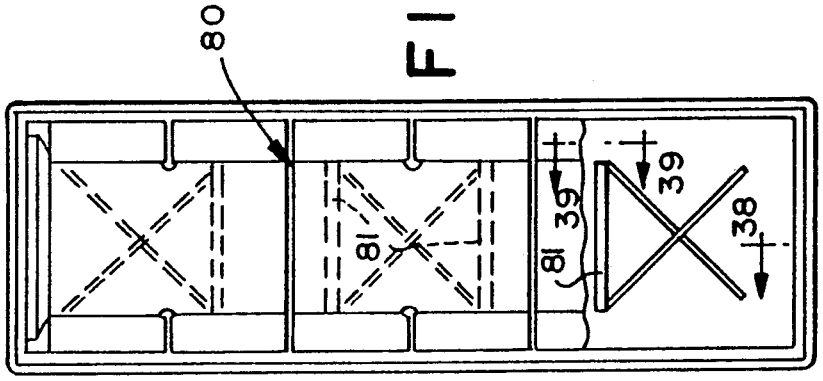
FIG. 35 is a rear view in elevation of the door of FIGS. 28 and 29, with portions broken away to show various insulation-retaining features.
Figure 39:
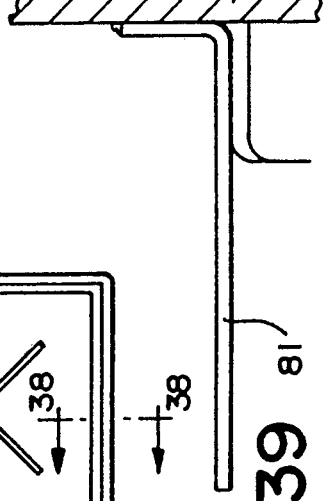
FIG. 39 is an enlarged sectional view taken along line 39—39 in FIG. 35.
Figure 41:
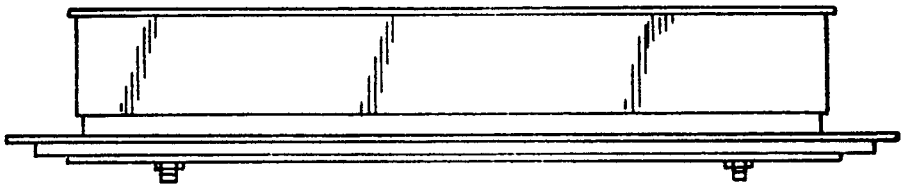
FIG. 41 is a side view in elevation of the frame and door assembly of FIG. 40.
Figure 40:
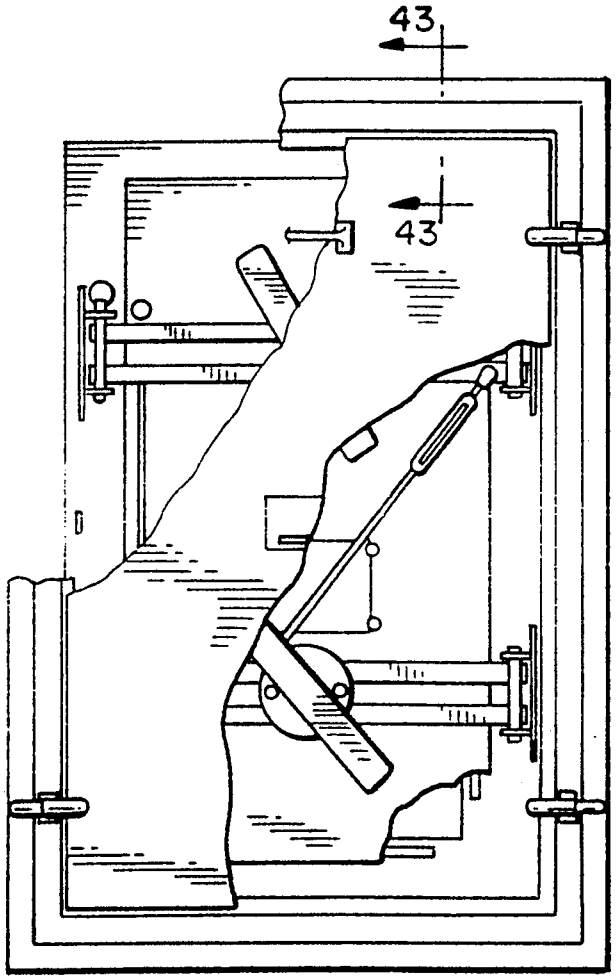
FIG. 40 is a front view in elevation, with portions broken away, of an installed door assembly according to the invention, including an outer door panel.
Figure 43:
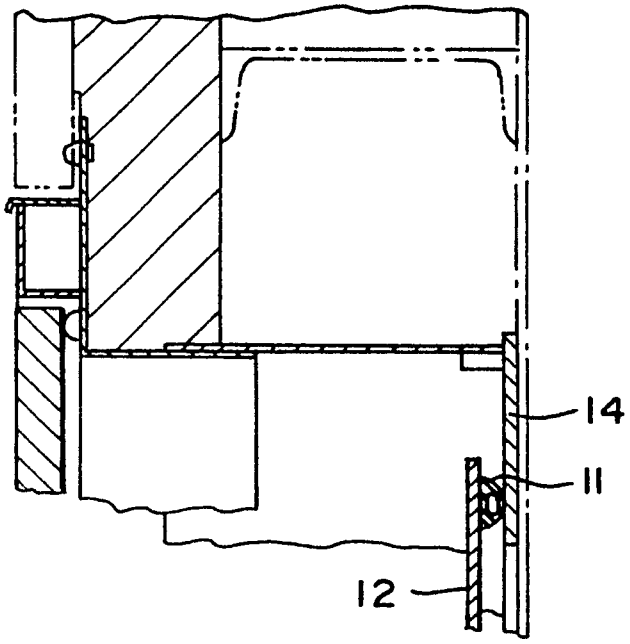
FIG. 43 is a greatly enlarged fragmentary sectional view taken along line 43—43 in FIG. 40.
Figure 42:
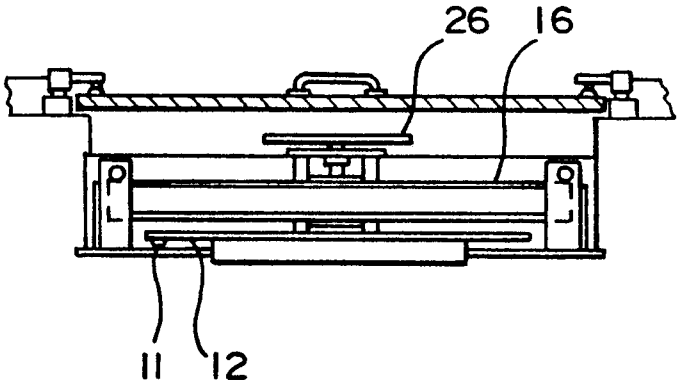
FIG. 42 is a fragmentary, somewhat schematic sectional view, looking from the bottom, of the door assembly of FIG. 40.
Figure 44:
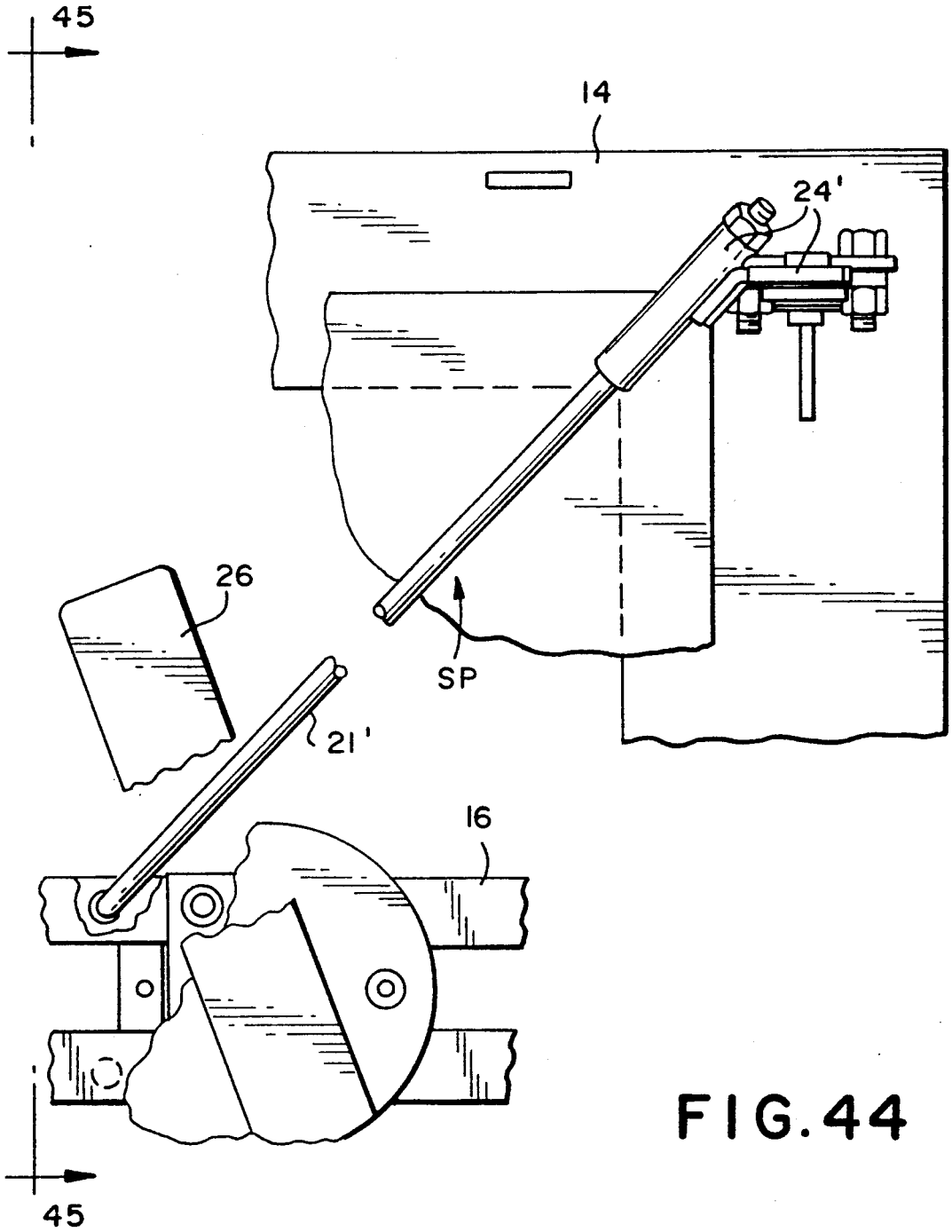
FIG. 44 is a fragmentary, front elevational view, with portions broken away, of the reversible sag rod structure used with the door of the invention.
Figure 45:
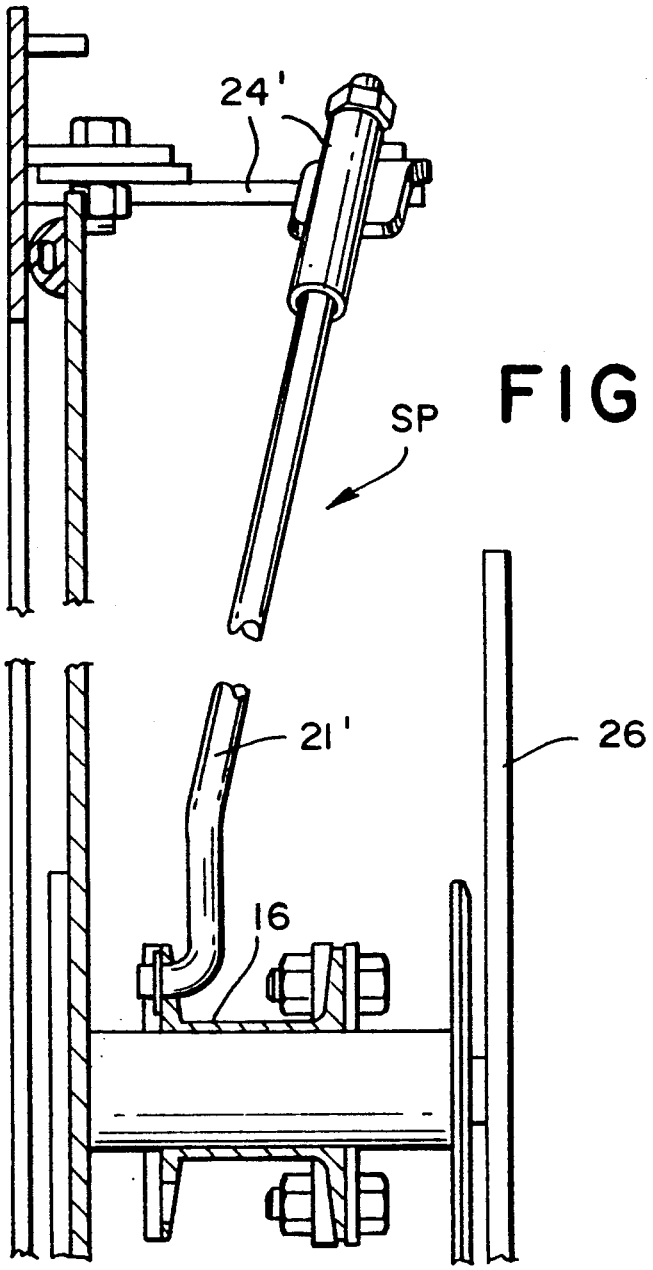
FIG. 45 is a fragmentary sectional view taken along line 45—45 in FIG. 44.
Figure 46:
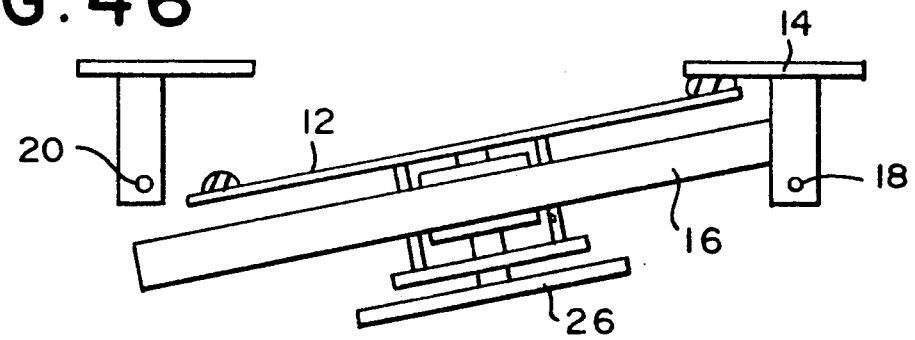
FIG. 46 is a schematic illustration of how the seal may become pinched in a prior art door.
Figure 47:
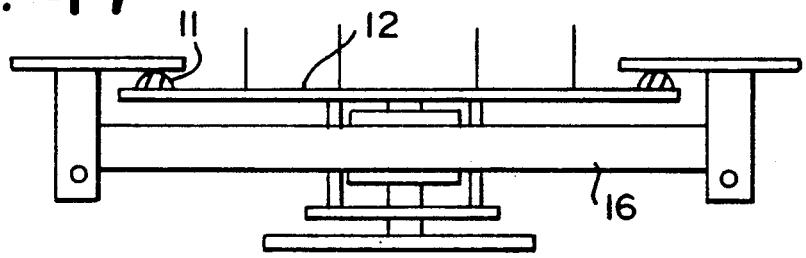
FIG. 47 is a schematic illustration of the door of FIG. 46 in closed position.

As shown in FIG. 27, the tapered sill is cast into a stepped configuration 69 which cooperates with the stepped configuration of the insulation plug. In this arrangement, a perimeter edge portion of each insulation layer 64, 66, 68, 70 is compressed by the stepped or tapered arrangement of the tapered sill when the door is closed. This same stepped arrangement can be applied to the tapered header (not shown).

FIG. 23 is a back elevational view of the door, showing the insulation plug and pins for securing it to the door plate. The ceramic retainers 63 can be seen as circles on the innermost layer of insulation. A plurality of stiffener bars 73 arranged in an X-shaped configuration on the back of the door plate assist in anchoring the insulation to the door plate.

FIGS. 28–39 are views of another embodiment of door installation according to the present invention. In this embodiment, the front portion of the door is the same or similar to the doors described above, except that three yoke assemblies 16 and associated screw jacks 26 are shown. This door would be used, for example, in a taller access opening. Moreover, the insulation plug 80 on this door differs substantially from that previously described. More specifically, the insulation plug comprises a soft insulation material 71 supported on horizontal shelf-like structures 81 affixed to the rear of the door plate and projecting perpendicularly therefrom. The insulation material is covered by a protective metal sheath or pan 82 having tapered sides 83 and 84 and tapered top and bottom ends 85 and 86. The sheath is formed of a plurality of panels or sections **82*a*, 82*b*, etc. The sections are secured to the back of the door plate by any suitable means, such as by bolting. A thin strip of insulation (not shown) can be supplied between the attaching flange of these panels and the door plate to provide a thermal barrier. There exists an expansion joint between adjacent panel sections to accommodate thermal expansion of the panel sections during high temperature operation of the door. The panel sections are provided with interlocking fingers 90, 91** at the expansion joints to maintain alignment of the panels during use and aging of the door. Further, the tapered sides of each panel section are provided with an expansion slot joint ending in a hole at the edge of the taper.

The shelves previously described are attached to the rear surface of the door plate and extend toward the sheath panel sections. However, the shelves do not touch the panel sections to thereby assure a thermal barrier. A strip of insulation (not shown) may be provided between each shelf and panel section to increase the rating of the thermal barrier.

Further, the access opening in the waterwall is constructed by bending the tubes of the waterwall outwardly and casting a frame of refractory material 93 about the cooling tubes 30, providing a finished frame with a tapered access opening.

FIGS. 40–45 show the details of a reversible door sag preventer SP can be reversibly mounted for left-hand or right-hand door openings. To this end, the door and panel assembly are constructed so that they are essentially symmetrical, whereby for a right-hand door, for example, the entire assembly is placed in a waterwall opening in the orientation shown in FIG. 40, for example, while for a left-hand door the assembly is merely inverted or turned upside down and placed in the opening through the waterwall, and the sag rod 21 changed from the brackets 24 shown to corresponding brackets at the opposite end of the door an on the yoke assemblies.

Figure 53:
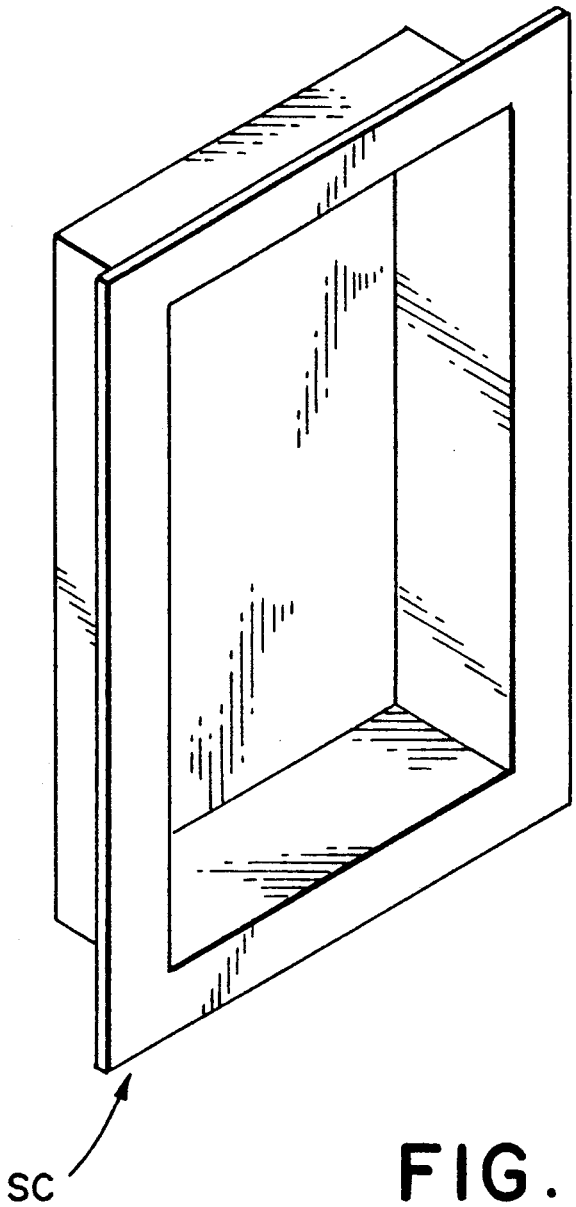
FIG. 53 is a rear perspective view of the packing case of FIGS. 51 and 52.

FIGS. 51–53 show the packing crate or shipping carton SC in which the door assembly is shipped and/or stored. This same packing or shipping crate may be secured over the insulation plug on the door while the door is removed from the panel assembly or opened for service, etc. Thus, this carton serves the dual role of protecting especially the rather fragile insulation plug during shipping and storage, as well as during periods of service requiring the door to be opened or removed after it has been installed.

While the invention has been shown and described in detail, it is obvious that this invention is not to be considered as being limited to the exact form disclosed, and that changes in detail and construction may be made therein within the scope of the invention, without departing from the spirit thereof.

What is claimed is:

1. An access door for gaining access to the interior of a boiler, scrubber, precipitator, and the like, through an access opening formed through a waterwall constructed mainly of boiler tubes, comprising:

a tapered access opening through the waterwall defined by at least one tapered side, said tapered side being cooled by and including at least one tube connected with a boiler tube in the waterwall; and a door cooperating with said tapered opening and providing a gas tight seal with the waterwall, said door including an insulating plug having tapered sides to be accommodated within said tapered opening for providing at least a partial seal or barrier for hot gasses when the door is closed to minimize the elevation of temperature of an outer portion of the door during operation.

2. A door according to claim 1, wherein said tapered opening is defined by a plurality of cooling tubes constructed in a tapered arrangement.

3. A door according to claim 1, wherein said insulation plug is made of pliable material so as to provide a barrier of linear contact points preventing hot gasses from entering between said door and said tapered access opening.

4. A door according to claim 1, wherein said insulation plug is constructed of a single layer of insulation.

5. A door according to claim 1, wherein said insulation plug is constructed of plural layers of insulation laminated on top of one another.

6. A door according to claim 5, wherein said layers comprise different grades of insulation, with the highest grade being placed so as to be exposed to the highest temperature.

7. A door according to claim 5, wherein said plural layers of said insulation plug are glued together and secured to said door by ceramic pins and retainers.

8. A door according to claim 6, wherein said plural layers of said insulation plug are glued together and secured to said door by ceramic pins and retainers.

9. A door according to claim 1, wherein said insulation plug has a stepped, tapered configuration.

10. A door according to claim 9, wherein said insulation plug has a stepped, tapered configuration providing multiple, linearly aligned contact surfaces with said tapered opening.

11. A door according to claim 2, wherein said insulation plug has a stepped, tapered configuration.

12. A door according to claim 11, wherein said stepped, tapered configuration provides multiple, linearly aligned contact surfaces for engagement with said tubes defining said tapered access opening, for cooling said insulation plug.

13. A door according to claim 12, wherein said insulation plug is made of multiple layers of insulation with each layer making contact and being cooled by a set of tubes defining said tapered access opening.

14. A door according to claim 13, wherein said insulation plug is made of multiple layers of different grades of insulation glued together and secured to said door by ceramic pins and retainers.

15. A door according to claim 1, wherein said tapered opening is defined by a plurality of boiler tubes constructed in a substantially linear arrangement positioned substantially perpendicular to a plane of the waterwall at the access opening, said boiler tubes being encased by a construction to define said tapered side of said tapered access opening.

16. A door according to claim 15, wherein said boiler tubes are encased in a castable refractory that has been formed to define said tapered side of said tapered access opening.

17. A door according to claim 1, wherein said insulation plug is defined by a sheet metal construction bent into an arrangement having tapered sides and mounted on said door to provide a cavity, said cavity being at least partially filled with insulation material.

18. A door according to claim 17, wherein said sheet metal construction is provided in multiple sections with slots and expansion joints provided between adjacent sections.

19. A door according to claim 1, wherein said tapered access opening is formed through a panel section that is fabricated and placed in an opening formed through a waterwall, and said door is hingedly mounted on said panel section adjacent said tapered access opening.

20. A door according to claim 19, wherein said door is movably mounted on at least one support yoke means, said support yoke means being hingedly mounted on the panel section adjacent said tapered opening, and means is provided between the door and support yoke means for driving said door into and out of said tapered access opening for tightly closing and opening said door.

21. A door according to claim 1, wherein the door comprises a movable door plate mounted to a support yoke means that is hingedly mounted for movement relative to the access opening, said door plate being movable into and out of gas-tight, sealing ans closing relationship with respect to a door frame means, and a flexible sealing gasket carried by said door plate for effecting said gas-tight seal with said door frame means.

22. A door according to claim 21, wherein actuating means is connected between said support yoke means and the door plate for moving the door plate relative to the support yoke means and the door frame means, said door plate being flexibly mounted to the support yoke means by the actuating means for self-adjusting positioning with respect to the door frame means as the door is moved into closed position.

23. A door according to claim 22, wherein a preload spring is connected between the support yoke means and the door plate to prevent opening of the door until the door plate is moved into a position by the actuating means that permits opening of the door without damaging the sealing gasket.

* * * * *